US007654199B2

(12) United States Patent
Nagai

(10) Patent No.: US 7,654,199 B2
(45) Date of Patent: Feb. 2, 2010

(54) PRINTING DEVICE

(75) Inventor: Koji Nagai, Miyagi (JP)

(73) Assignee: Tohoku Ricoh Co., Ltd., Tokyo (JP)

( * ) Notice: Subject to any disclaimer, the term of this patent is extended or adjusted under 35 U.S.C. 154(b) by 299 days.

(21) Appl. No.: 11/366,543

(22) Filed: Mar. 3, 2006

(65) Prior Publication Data

US 2006/0266233 A1 Nov. 30, 2006

(30) Foreign Application Priority Data

May 26, 2005 (JP) ..... 2005-153816

(51) Int. Cl.
*B41L 13/00* (2006.01)

(52) U.S. Cl. ..... 101/119; 101/116

(58) Field of Classification Search ..... 101/114, 101/115, 116, 119, 120, 128.21, 128.4, 129
See application file for complete search history.

(56) References Cited

U.S. PATENT DOCUMENTS 5,517,913 A * 5/1996 Oshio et al. ..... 101/119
6,786,146 B2 * 9/2004 Kidoura et al. ..... 101/128.4
2006/0044341 A1 * 3/2006 Reichelsheimer et al. ..... 347/19

FOREIGN PATENT DOCUMENTS

JP 4-35188 8/1992
JP 5-64878 3/1993

OTHER PUBLICATIONS

English machine translation of JP 05-064878 obtained from the JPO website.*

* cited by examiner

*Primary Examiner*—Ren Yan
(74) *Attorney, Agent, or Firm*—Oblon, Spivak, McClelland, Maier & Neustadt, L.L.P.

(57) ABSTRACT

A printing device capable of printing with either UV curable ink or non-UV curable ink and having a function of controlling so that printing under the printing conditions of the printing device in accordance with the selected ink to be used can be performed with simple operation. The printing device has a controller for performing control of executing warning report and/or disabling printing operation, when the type of the ink identified by the ink type detection device is not consistent with the type of the master identified by the master type detection device.

6 Claims, 17 Drawing Sheets

FIG. 17

| DRUM TYPE | INK TYPE | MASTER TYPE | REMOVED-MASTER TYPE | ASSESSMENT |
|---|---|---|---|---|
| NON-UV | NON-UV | NON-UV | NON-UV | APPROPRIATE |
| | | | UV | APPROPRIATE |
| | | UV | NON-UV | INAPPROPRIATE |
| | | | UV | INAPPROPRIATE |
| | UV | NON-UV | NON-UV | INAPPROPRIATE |
| | | | UV | INAPPROPRIATE |
| | | UV | NON-UV | INAPPROPRIATE |
| | | | UV | INAPPROPRIATE |
| UV | NON-UV | NON-UV | NON-UV | APPROPRIATE |
| | | | UV | APPROPRIATE |
| | | UV | NON-UV | INAPPROPRIATE |
| | | | UV | INAPPROPRIATE |
| | UV | NON-UV | NON-UV | INAPPROPRIATE |
| | | | UV | INAPPROPRIATE |
| | | UV | NON-UV | INAPPROPRIATE |
| | | | UV | APPROPRIATE |

FIG. 18

| DETECTED TEMPERATURE | REDUCED PULSE RATE (%) | |
|---|---|---|
| | NON-UV PRINTING | UV PRINTING |
| ~10 | 10 | 5 |
| 11 | 11 | 6 |
| 12 | 12 | 7 |
| 13 | 13 | 8 |
| 14 | 14 | 9 |
| 15 | 15 | 10 |
| 16 | 16 | 11 |
| 17 | 17 | 12 |
| 18 | 18 | 13 |
| 19 | 19 | 14 |
| 20 | 20 | 15 |
| 21 | 21 | 16 |
| 22 | 22 | 17 |
| 23 | 23 | 18 |
| 24 | 24 | 19 |
| 25 | 25 | 20 |
| 26 | 26 | 21 |
| 27 | 27 | 22 |
| 28 | 28 | 23 |
| 29 | 29 | 24 |
| 30 | 30 | 25 |
| 31 | 31 | 26 |
| 32 | 32 | 27 |
| 33 | 33 | 28 |
| 34 | 34 | 29 |
| 35 | 35 | 30 |
| 36 | 36 | 31 |
| 37 | 37 | 32 |
| 38 | 38 | 33 |
| 39~ | 39 | 34 |

FIG. 19

| DETECTED TEMPERATURE | PRINTING PRESSURE (kgf) | | | | | |
|---|---|---|---|---|---|---|
| | NON-UV PRINTING | | | UV PRINTING | | |
| | FIRST SPEED | THIRD SPEED | FIFTH SPEED | FIRST SPEED | THIRD SPEED | FIFTH SPEED |
| ~10 | 20 | 22 | 24 | 22 | 24 | 26 |
| 11 | 20 | 22 | 24 | 22 | 24 | 26 |
| 12 | 20 | 22 | 24 | 22 | 24 | 26 |
| 13 | 19 | 21 | 23 | 21 | 23 | 25 |
| 14 | 19 | 21 | 23 | 21 | 23 | 25 |
| 15 | 19 | 21 | 23 | 21 | 23 | 25 |
| 16 | 18 | 20 | 22 | 20 | 22 | 24 |
| 17 | 18 | 20 | 22 | 20 | 22 | 24 |
| 18 | 18 | 20 | 22 | 20 | 22 | 24 |
| 19 | 17 | 19 | 21 | 19 | 21 | 23 |
| 20 | 17 | 19 | 21 | 19 | 21 | 23 |
| 21 | 17 | 18 | 21 | 19 | 20 | 23 |
| 22 | 16 | 18 | 20 | 18 | 20 | 22 |
| 23 | 16 | 17 | 20 | 18 | 19 | 22 |
| 24 | 16 | 17 | 20 | 18 | 19 | 22 |
| 25 | 15 | 16 | 19 | 17 | 18 | 21 |
| 26 | 15 | 16 | 19 | 17 | 18 | 21 |
| 27 | 15 | 15 | 18 | 17 | 17 | 20 |
| 28 | 14 | 15 | 18 | 16 | 17 | 20 |
| 29 | 14 | 14 | 17 | 16 | 16 | 19 |
| 30 | 14 | 14 | 17 | 16 | 16 | 19 |
| 31 | 13 | 13 | 16 | 15 | 15 | 18 |
| 32 | 13 | 13 | 16 | 15 | 15 | 18 |
| 33 | 13 | 13 | 15 | 15 | 15 | 17 |
| 34 | 13 | 13 | 15 | 15 | 15 | 17 |
| 35 | 13 | 13 | 14 | 15 | 15 | 16 |
| 36 | 13 | 13 | 14 | 15 | 15 | 16 |
| 37 | 13 | 13 | 13 | 15 | 15 | 15 |
| 38 | 13 | 13 | 13 | 15 | 15 | 15 |
| 39~ | 13 | 13 | 13 | 15 | 15 | 15 |

PRINTING DEVICE

BACKGROUND OF THE INVENTION

1. Field of the Invention

The present invention relates to a printing device, and particularly to a printing device having a stencil printing device for performing stencil printing using a UV curable ink.

2. Description of the Related Art

A stencil printing device is widely used for printing various distributed papers and documents in educational markets, public offices, partnership organizations, hospitals and the like, and for obtaining a number of printed matters or a number of copies of printed matters such as newspaper inserts, classifieds, messages inside private companies, and various other documents, because it is capable of printing at high speeds at low running cost. In order for anyone to be able to operate such a printing device easily at anytime, the printing ink employed in this printing device is the one which normally is not solidified in the atmosphere, and the printing device is designed such that troubles such as cleaning of the print drum portion every time the printing device is used can be eliminated.

Since the stencil ink is designed such that it penetrates a piece of printing paper, which is an example of a sheet-like recording medium, and is dried in appearance, the surface of the printed matter easily becomes messy if rubbed by hand, due to the undried ink. This fact has been pointed out as a significant problem of the stencil printing device from the past, but no effective countermeasures have been implemented.

As a conventional printing device for improving the drying performance of printed matters, for example, Examined Utility Model Application Publication No. H4-35188, Japanese Patent Application Laid-Open No. H5-64878, and the like propose a stencil printing device designed for UV curable ink, which comprises an ultraviolet (also referred to as "UV" hereinafter) irradiation apparatus and performs stencil printing using a UV curable ink (also referred to as "UV ink" hereinafter).

The stencil printing device disclosed in Examined Utility Model Application Publication No. H4-35188 is a stencil printing device designed for UV ink, in which only a UV ink can be used, thus, if printing needed to be performed with non-UV ink, another stencil printing device, which is designed for non-UV ink, was required. On the other hand, the printing device disclosed in Japanese Patent Application Laid-Open No. H5-64878 can perform printing with normal inks, but the paper conveying means has to be removed, and operations/performances on the device were extremely troublesome.

SUMMARY OF THE INVENTION

An object of the present invention, therefore, is to provide a printing device which has a function of performing control on printing such that printing can be performed with simple operation using any UV inks or non-UV inks under the printing conditions of the printing device that correspond to a selected ink.

In accordance with an aspect of the present invention, a printing device is capable of printing with either UV curable ink or non-UV curable ink. The printing device comprises an ink detection device configured to detect whether ink installed in a print drum is the UV curable ink or the non-UV curable ink; a master detection device configured to detect whether a master installed in the printing device is a master for UV curable ink or a master for non-UV curable ink; and a control device configured to perform control of executing warning report and/or disabling printing operation, when the type of the ink identified by the ink detection device is not consistent with the type of the master identified by the master detection device.

In another aspect of the present invention, a printing device is capable of printing with either UV curable ink or non-UV curable ink. The printing device comprises an ink detection device configured to detect whether ink installed in a print drum is the UV curable ink or the non-UV curable ink; a master perforation device configured to perforate a master; and a control device configured to adjust supply energy to the master perforation device to supply energy suitable for the UV curable ink which is different from the non-UV curable ink, when the UV curable ink is detected by the ink detection device.

In another aspect of the present invention, a printing device is capable of printing with either UV curable ink or non-UV curable ink. The printing device comprises a print drum around which a perforated master is wrapped; a pressing device configured to press a print medium and the print drum to perform printing, the pressing device being set opposite to the print drum; and a control device configured to adjust the pressing force to pressing force suitable for the UV curable ink which is different from the non-UV curable ink, when the UV curable ink is detected by the ink detection device.

BRIEF DESCRIPTION OF THE DRAWINGS

The above and other objects, features and advantages of the present invention will become more apparent from the following detailed description taken with the accompanying drawings in which:

FIG. 17 is a table showing a combination of a print drum, ink, master, and master remover;

FIG. 18 is a table showing comparison of energy supplied to perforation means in the case of UV printing and of non-UV printing; and FIG. 19 is a table showing printing pressure with respect to detected temperature in UV printing and non-UV printing.

DESCRIPTION OF THE PREFERRED EMBODIMENTS

Hereinafter, an embodiment of the present invention is described with reference to the drawings.

[1] Summary of Stencil Printing Device

Figure 1:
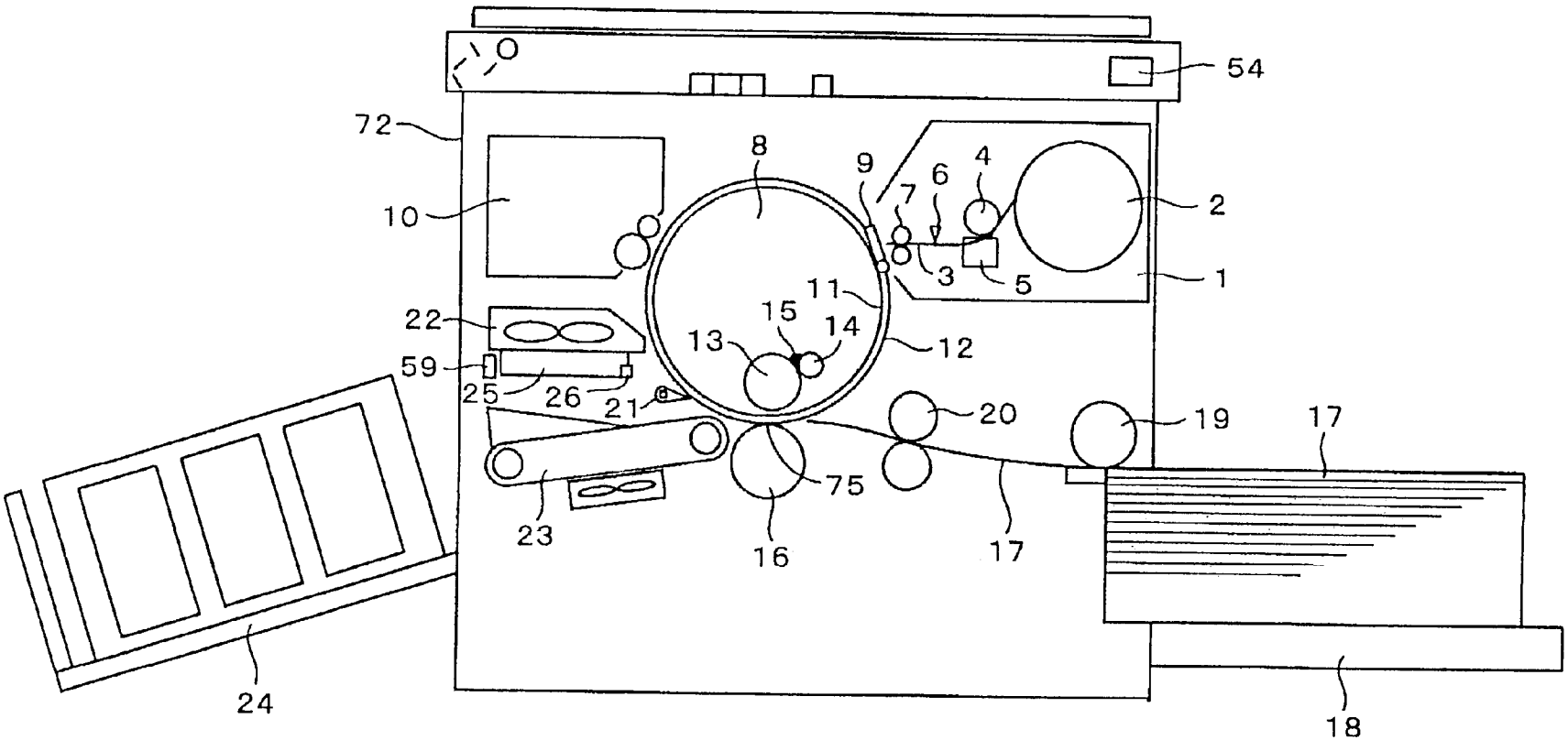
FIG. 1 is a figure showing an entire schematic configuration of a printing device related to an embodiment of the present invention.

FIG. 1 is a schematic view showing an example of a stencil printing capable of performing printing using either UV inks or non-UV inks. In FIG. 1, an upper portion of a printing device main body 72 is provided with an operation panel 54. In a master-making unit 1 provided inside the printing device main body, a master roll 2 is rotatably supported, and a let out master 3 is pressed against a heater element of a thermal head 5 by a platen roller 4 and is subjected to perforation in accordance with a pattern on a draft which is read by an unshown scanner.

The master 3 which is processed through perforation is trimmed by a cutter unit 6, and conveyed to a master damper 9 of a print drum 8 by a master-loading roller 7. The conveyed master 3 is then clamped at its leading end portion by the master damper 9, and wrapped around the print drum 8 as the print drum 8 rotates. On the other hand, while the master 3 is subjected to perforation in accordance with the draft pattern, the master, which was used in the previous printing and is on the print drum 8, is removed by a removed-master storage device 10. After completion of removal by the removed-master storage device 10, the perforated master 3 is wrapped around the print drum 8.

The print drum 8 is rotated clockwise by a driving device which is not shown. A cylindrical and curved outer circumferential portion of the print drum 8 comprises a stainless printing cylinder 11, which forms a porous cylindrical structure with a minute hole, and a mesh screen 12 which is wrapped around an outer circumference of the printing cylinder 11.

The inside of the print drum 8 is provided with an ink roller 13, which rotates synchronously with the print drum 8 in the same direction, and a doctor roller 14, which is disposed slightly apart from an outer circumference of the ink roll 13. A pointed space formed between the ink roller 13 and the doctor roller 14 forms an ink pool 15. The ink in the ink pool 15 is supplied to an outer circumferential surface of the ink roller 13 by rotation of the ink roller 13 and doctor roller 14. The ink supplied to the outer circumferential surface of the ink roller 13 is further supplied to an inner circumferential surface of the printing cylinder 11 of the print drum 8.

A lower part of the print drum 8 is provided with a press roller 16, which is the pressing means placed opposite to the ink roller 13. The press roller 16 is the pressing means for pressing a printing paper 17 against the master 3 wrapped around the print drum 8, at a printing press portion 75, which is located on an outer circumferential surface of the print drum 8 facing the ink roller 13. The pressing means comprises a roller-like rotating body. The pressing roller may be the press roller shown in this embodiment, or an impression cylinder may be used as the pressing means.

Printing papers 17 are loaded on a paper feed tray 18 and conveyed to the printing press portion by a paper feed roller 19. Appropriate timing of conveying the conveyed printing papers 17 is adjusted so that the printing press portion can perform printing by means of a resist roller 20, and the conveyed printing papers 17 are fed to between the printing cylinder 11 and the press roller 16 at the adjusted timing. By pressing the printing paper against the printing cylinder 11 by means of the press roller 16, the draft pattern, which is used for perforation of the master 3, is transferred onto the printing paper 17.

The printing paper 17 after transfer of the draft pattern is separated from the printing cylinder 11 by wind force generated from a delivery nail 21 and an air knife unit 22 of the print drum 8, and conveyed to a delivery tray 24 by a suction conveyance unit 23 which is a combination of a conveying belt and a suction device.

In a section below the air knife unit 22 and facing a conveyance path used by the suction conveyance unit 23 for conveying the printing paper 17, there are provided a UV source control means 59 for controlling a UV source 25 for curing UV ink and for controlling ON/OFF emission of the UV source, and a sensor 26 for detecting the printing paper 17.

Figure 5:
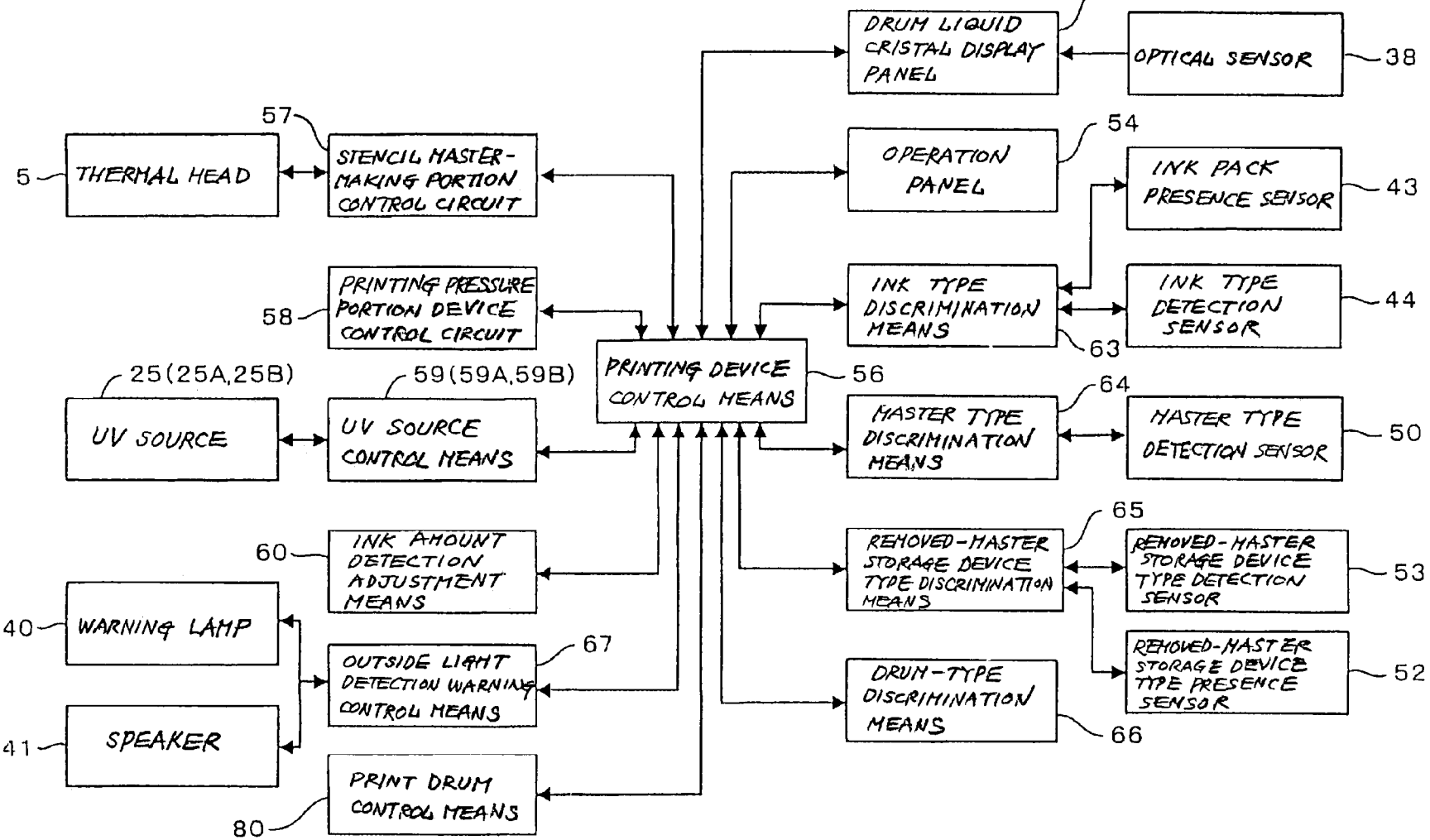
FIG. 5 is a block diagram showing a configuration of control means of the printing device.

When performing printing using UV ink, if the sensor 26 detects conveyance of a printed paper, the UV source control means 59 is driven by command information from printing device control means 56 which comprises a CPU, ROM, RAM and the like shown in FIG. 5, whereby the UV source 25 is emitted. When the sensor 26 detects that the conveyance of the printed paper is completed, ultraviolet radiation from the UV source 25 is turned off by the UV source control means 59.

Figure 2:
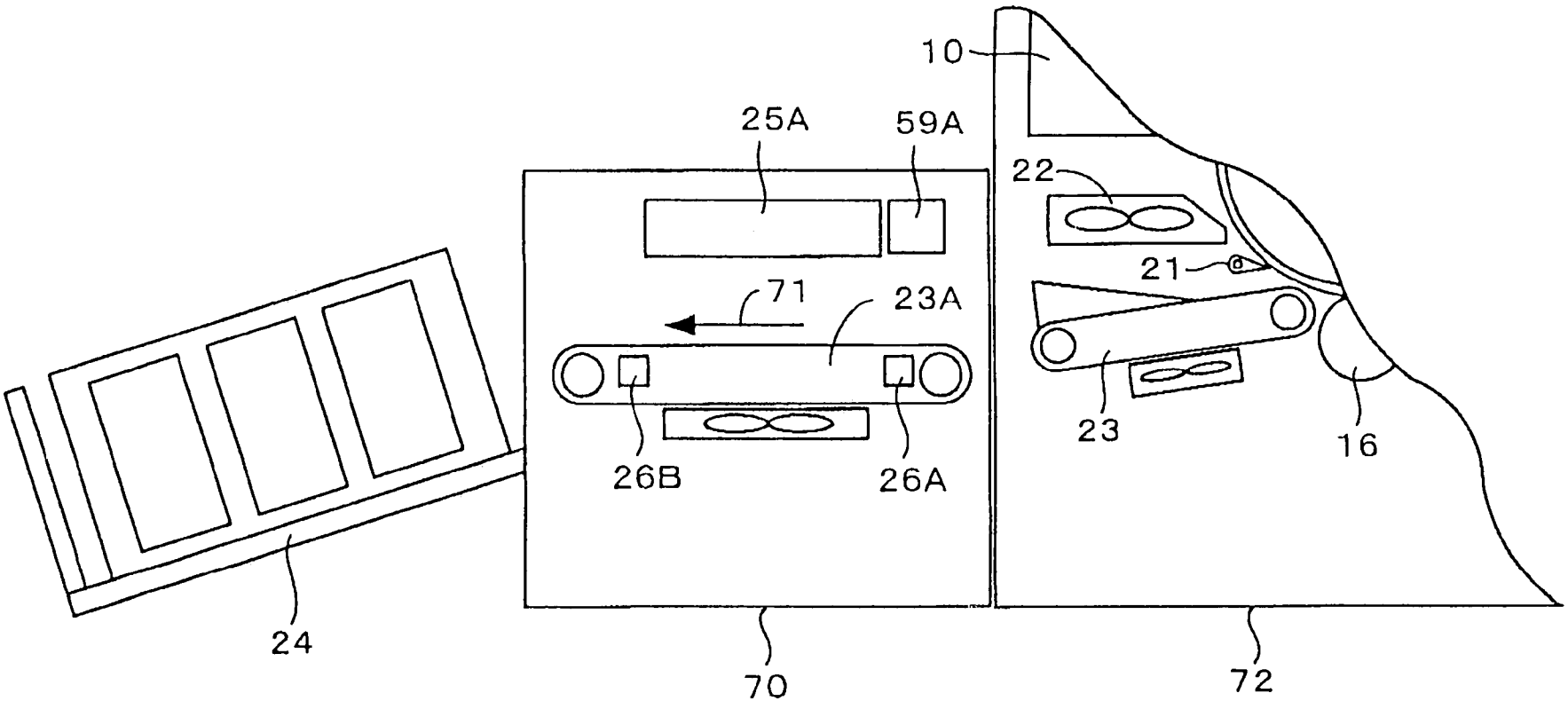
FIG. 2 is a figure showing a partial schematic configuration of the printing device.

The UV source 25 may be provided inside the printing device as shown in FIG. 1, or may be provided alone as a UV irradiation device 70 which can be attached optionally later on, as shown in FIG. 2. In an example shown in FIG. 2, the UV irradiation device 70 is provided with a suction conveyance unit 23A which is a combination of a conveying belt and an air suction device, and, instead of the UV source 25 and UV source control means 59 shown in FIG. 1, a UV source 25A and UV source control means 59A are provided in an upper section of the suction conveyance unit 23A.

Similarly in the example shown in FIG. 2, instead of the sensor 26 shown in FIG. 1, a sensor 26A, which detects a leading end portion of the printing paper and turns ON emission of ultraviolet of the UV source control means 59A, and a sensor 26 B, which detects a rear end portion of the printing paper and turns OFF emission of the ultraviolet of the UV source control means 59A, are provided respectively at an upstream side and down stream side of the printing paper conveyance direction indicated with an arrow 71, the sensors 26A and 26B being located inside the conveying belt configuring the suction conveyance unit 23A.

In the example shown in FIG. 2, when the sensors 26A and 26B provided in the suction conveyance unit 23A of the UV irradiation device 70 detect that the printed paper 17 is conveyed by the suction conveyance unit 23 on the printing device main body 72 side, the UV source control means 59A is driven by the command information from the printing device control means 56 shown in FIG. 5, and the UV source 25A is emitted or turned off.

In this manner, the ultraviolet can be radiated on the printing paper which is printed using the UV ink, and, by curing the UV ink, the occurrence of simple smear shortly after printing, which has occurred during printing when using the non-UV ink, can be prevented.

[2] Each Part on Stencil Printing Device

[2.1] Printing Drum Unit

FIG. 1 and FIG. 2 have described the examples or setting the UV sources 25, 25A and the like in the suction conveyance units 23, 23A, as the means of irradiating the printed paper with the ultraviolet. Here, however, an example of setting in the printing drum unit is described. The printing drum unit described hereinafter is detachable with respect to the printing device main body 72, and a user prepares, in advance, a printing drum unit specialized in printing using UV ink and a printing drum unit specialized in printing using non-UV ink. The printing drum unit is replaced beforehand in accordance with change of these printing methods.

A print drum for UV ink is installed in the printing drum unit for printing with UV ink, and a print drum for non-UV ink is installed in the printing drum unit for printing with non-UV ink. Print drum control means 80 provided in the printing drum unit recognizes whether the print drum installed in the printing device main body 72 is for UV ink or non-UV ink. Discrimination information for discriminating the drum types is transmitted to the printing device control means 56 (see FIG. 5).

Figure 3:
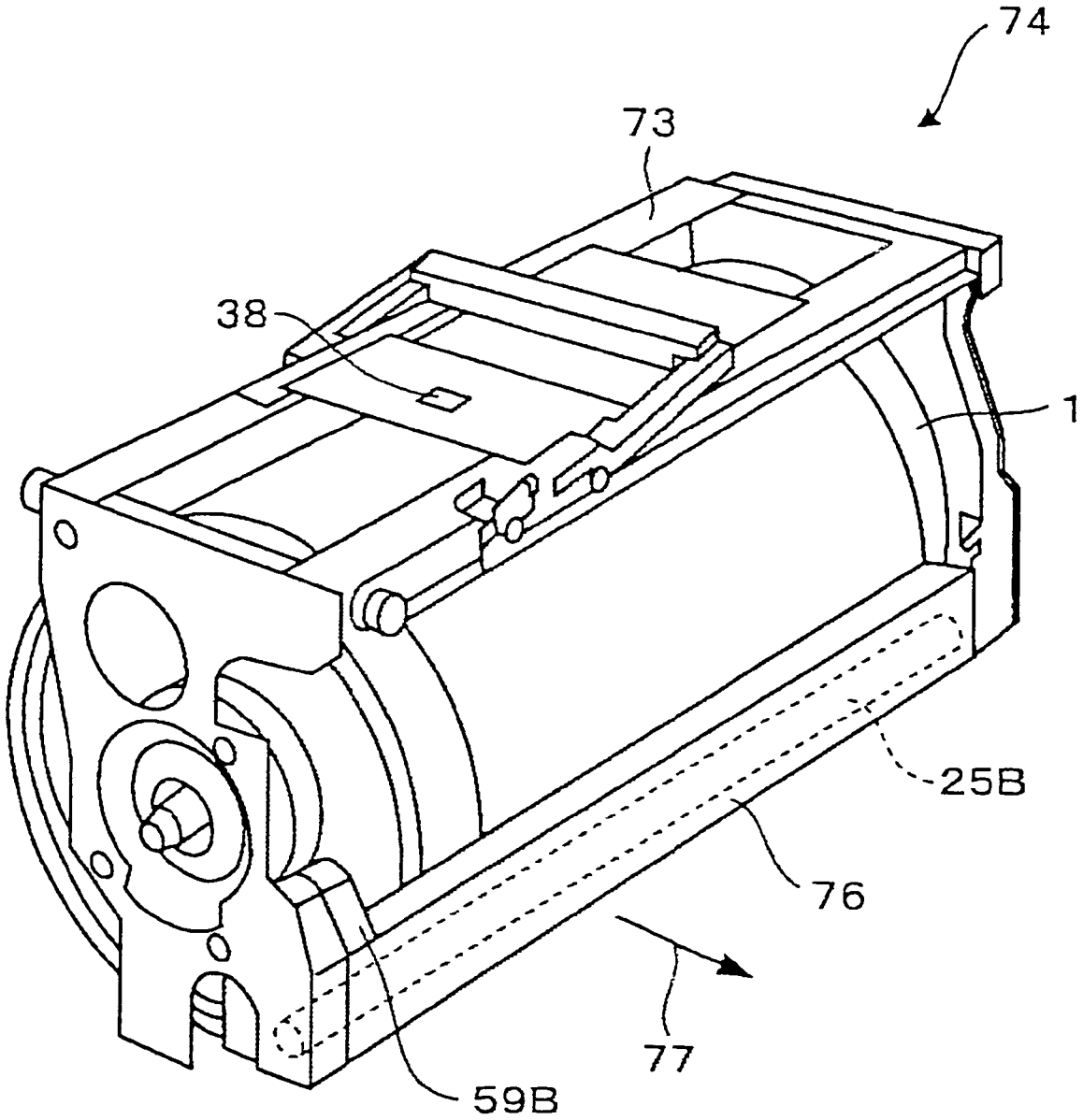
FIG. 3 is a perspective view showing an appearance of a printing drum unit of the printing device.
Figure 4:
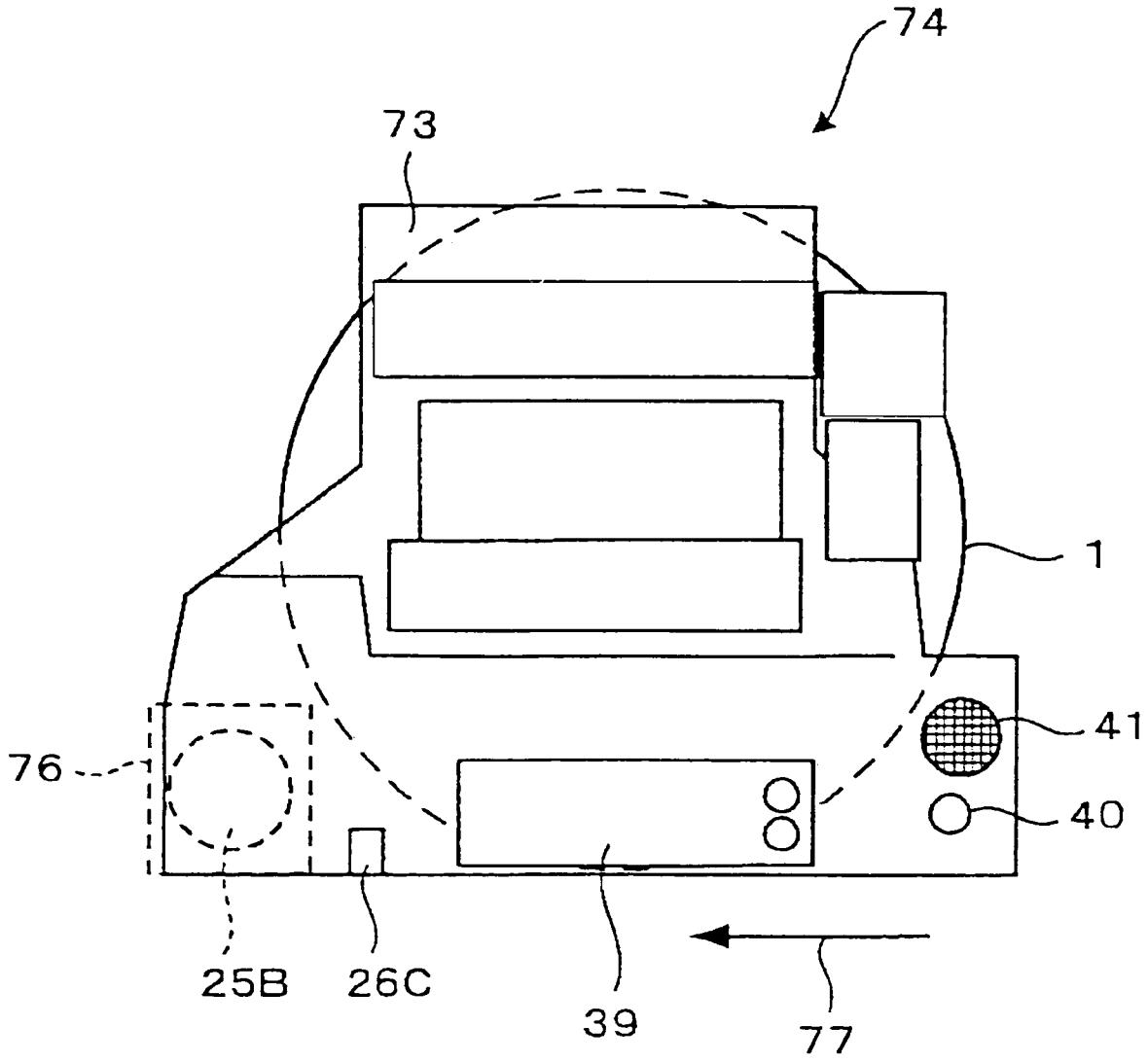
FIG. 4 is a side view showing of the printing drum unit.

In FIG. 3 and FIG. 4, the print drum 8 is supported rotatably by and integrated with a case 73, and the entire print drum 8 configures a printing drum unit 74. An elongated chassis portion 76 is formed along the direction of an axis line of the print drum 8 is formed in a side delivery portion, which is located at a lower portion of the case 73, on the paper conveyance direction of the printing paper, and a down stream side of the printing press portion 75. A UV source 25B is installed inside this chassis portion 76.

The chassis potion 76 is formed such that only a section thereof corresponding to the bottom surface is opened outward so that the print drum 8 is not irradiated directly with the ultraviolet and only the printing paper is irradiated with the ultraviolet.

The UV source 25B may be fixed to the case 73 for every container configuring the chassis portion 76, or may be detachable with respect to the chassis portion 76. A light reflection type sensor 26C is provided between the print drum 8 and the UV source 25B on the paper conveyance direction indicated with an arrow 77, and UV source control means 59B is also provided.

When the sensor 26C detects the printing paper 17 which is printed in the printing drum 8, the UV source control means 59B is driven by the command in formation from the printing device control means 56 shown in FIG. 5, and the UV source 25B is emitted or turned off.

Furthermore, in the case 73 an unshown substrate is provided with a DIP switch and the like. When the types of the print drums (for example, the print drum for UV ink or not) installed in the printing device main body 72 are subjected to setting by mean so the DIP switch to install the printing drum unit 74 in the printing device main body, the information of the DIP switch is transmitted and discriminated by drum type discrimination means 66 shown in FIG. 5, and the printing device control means 56 performs control in accordance with the print drums.

When performing printing using the UV ink, if the drum unit filled with the UV ink is left outside the printing device for a long period of time, the ink is cured by the ultraviolet in the sunlight. For this reason, as shown in FIG. 3, the print drum which can use the UV ink is preferably provided with a light sensor 38 which detects outside light including the sunlight. The time between detection of the outside light and display of a warning may be based on previously set time, or may be set by a user with reference to the operation panel 54 provided in the printing device main body 72 as shown in FIG. 1 and FIG. 5, or alternatively may be set with reference to a drum liquid crystal display panel 39 provided in the case 73 as shown in FIG. 4.

Outside light detection warning control means 67 as the control means for outputting a warning when outside light is detected, as shown in FIG. 5, is sometimes set in the printing device main body 72 shown in FIG. 1 or set in the printing drum unit 74 shown in FIGS. 3 and 4. Alternatively, it can be set in both the printing device main body and the printing drum unit to carry out exchange of left-alone information when installing the printing drum unit 74 in the printing device main body 72.

Moreover, not only when installing the printing drum unit 74 in the printing device main body 72, but also when leaving the print drum 8 outside the printing device, the print drum control means 80 (see FIG. 5) provided on the printing device main body 72 and printing drum unit 74 can be allowed to have a radio communication function to cause the operation panel 54 to display the statuses of the print drum 8 placed outside the printing device, such that the statuses of the print drum 8 can be recognized in the printing device main body 72.

As shown in FIG. 5, the outside light detection warning control means 67 comprises a CPU, ROM, RAM and the like, and manages set detection time. When the set detection time has elapsed, the outside light detection warning control means 67 displays a warning on the operation panel 54 of the main body and on the drum liquid crystal display panel 39 provided in the printing drum unit 74, turns on a warning lamp 40, and alarms a warning beep from a speaker 41. These warning display operations may be combined, or one warning display operation may be performed alone.

The operation panel 54 on the printing main body side is caused to display warnings when the print drum 8 is installed in the printing device after the set outside light detection time has overly elapsed, or when the time, during which the print drum 8 is left outside the printing device and exposed to the outside light due to wireless communication or the like, has exceeded a set value. In such cases, there is a possibility that the UV curable ink inside the print drum 8 is cured by the outside light.

When the print drum 8 in which the ink is probably cured is installed in the printing device main body 72, the printing device displays, on the operation panel 54, the fact that the ink inside the print drum is cured and thus the printing cannot be performed, disables the printing operation, and promptly calls a service man. Alternatively, the printing device displays, on the operation panel 54, the fact that the drum with cured ink is in the process of recovery, and puts the user on standby.

In the meantime, new ink is filled into the print drum 8 from an ink pack 78 (see FIG. 6), the cured ink is dissolved by the solvent in the new ink, and the cured ink attached to the printing cylinder 11 configuring the print drum 8 is scraped off by an unshown blade inside the drum. After this series of recovery operation, control for starting printing operation is performed.

The liquid crystal panel 39, the warning lamp 40, and the speaker 41 on the print drum side are caused to display warnings when the set outside light detection time has overly elapsed and the print drum is exposed to the outside light outside the printing device. These warning devices prompt the user to move the print drum to a place out of the outside light or to install the print drum in the printing device main body. The printing device is hardly exposed to the outside light if closed with a front cover.

Ink Detection Means

Here is described ink detection means for discriminating whether the ink type installed in a print drum 1 is UV ink or non-UV ink.

Figure 6:
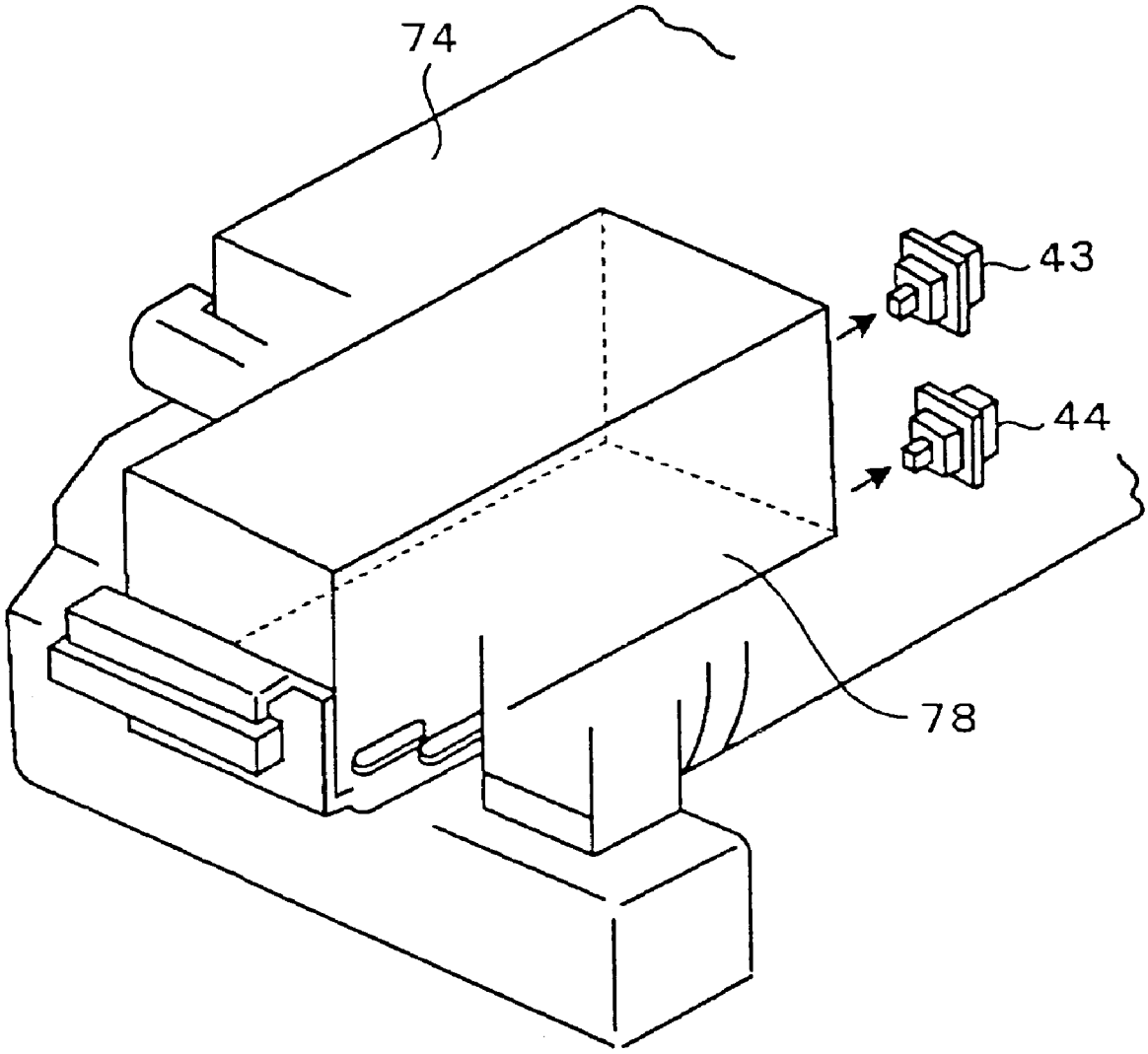
FIG. 6 is a perspective view of a part of the printing drum unit.

FIG. 6 is a figure for explaining means for discriminating the ink types. In the present embodiment, discrimination of whether the ink supplied to the print drum 1 is UV ink or non-UV ink is performed by using ink packs which have different shapes in accordance with the ink type and by discriminating changes in the shapes.

The shape of the ink pack is changed by detecting the presence of a notch. The printing drum unit 74 is provided with an ink pack presence sensor 43, which is a push switch, and an ink type detection sensor 44, which is also a push switch. Regarding the ink pack 78 which is detachable with respect to the printing drum unit 74, the structure of the ink pack having UV ink stored therein and the structure of the ink pack having non-UV ink stored therein are the same, except for the presence of notches. The user can select either one of the ink packs to install in the same printing drum unit 74.

Therefore, either the ink pack having UV ink stored therein, or the ink pack having non-UV ink stored therein is provided with a notch so that the push switches are not pressed or "missed" in a state where the ink pack is installed. For example, ink type discrimination means 63 is caused beforehand to store information indicating that the ink pack with the notch is the ink pack with UV ink and information indicating that the ink pack without the notch is the ink pack with non-UV ink.

Consequently, it is possible to judge that the installed ink pack is the one with non-UV ink if the ink pack presses the push switch of the ink type detection sensor 44, or that the installed ink pack is the one with UV ink if the ink pack does not press the push switch of the ink type detection sensor 44. In this manner, the ink type discrimination means 63 (FIG. 5) on the printing device main body 72 side identifies the ink type on the basis of the presence of contact of the ink pack with the ink type detection sensor 44.

It should be noted in FIG. 6 that an arrow is used to indicate the direction in which the ink pack 78 presses the ink pack presence sensor 43 and ink type detection sensor 44. The positions of the ink pack presence sensor 43 and the ink type detection sensor 44 are shown slightly away from the original set positions, for the reason of illustration. Further, the ink pack 78 shown in the figure is the one without the notch.

Another example of the ink detection means is described.

As ink detection means different from the one in the example described in FIG. 6, there is a method of attaching an IC tag to the ink pack to discriminate the ink types by means of the ink type discrimination means 63 of the printing device main body 72. The method of recognition using IC tags is known as a reading method using a special reader to read an IC tag which is configured as a compact device obtained by combining an IC chip for recording information and a wireless communication antenna.

Moreover, other than the recognition method using IC tags, it is possible to use a method of identifying the ink type by attaching a black sticker to the ink pack with UV ink or the ink pack with non-UV ink, and using an optical sensor, which is attached to the printing device main body 72, to compare the reflectance between the ink pack with the sticker and the ink pack without the sticker. Not only is it possible to perform discrimination of the ink types between the UV ink and non-UV ink, but also it is possible to perform discrimination in an extension of the present embodiment, that is, in a plurality of UV ink types in the UV ink.

Ink Amount Detection Adjustment Means

The detected ink sensitivity, which is detected by the sensors, is different between the UV ink and non-UV ink, thus it is preferred that amount of each ink be adjusted to optimal amount in the print drum 8. Once the ink type is identified by the ink type discrimination means 63 shown in FIG. 5, ink amount detection adjustment means 60 refers to an ink table, which is set beforehand in accordance with the ink type, and adjust the amount of the ink inside the print drum 8.

The amount of the UV ink is not necessarily larger or smaller than that of the non-UV ink, and the optimal amount of ink varies depending on the type of the UV ink, thus, in light of this fact, an ink type and parameters of ink amount are set in the ink amount detection adjustment means 60 in advance.

Figure 7:
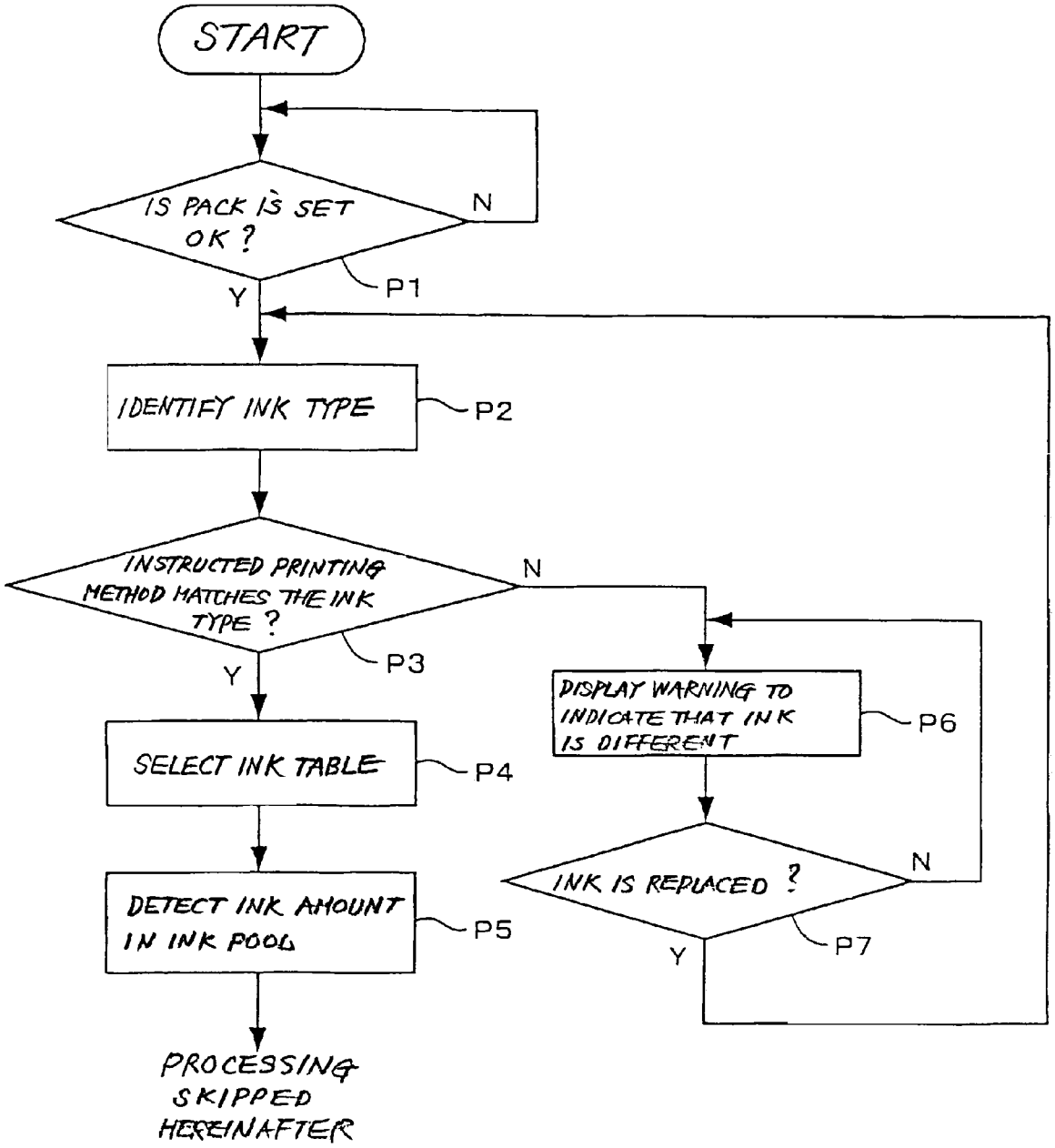
FIG. 7 is a flowchart for explaining a sequence of adjusting ink amount.

A sequence of adjustment of ink amount performed by the printing device control means 56 shown in FIG. 5 is described with reference to FIG. 7. In FIG. 7, in step P1 it is judged whether the ink pack is set or not, on the basis of detection information of the ink pack presence sensor 43. If the ink pack is set, the processing proceeds to step P2 in which the ink type is identified on the basis of a sensor output of the ink type detection sensor 44, and the processing proceeds to step P3.

In step P3 it is judged whether a printing method instructed by the user is used or not, i.e. whether printing is performed using the UV ink or non-UV ink, and whether the instructed printing method is consistent with the ink of the ink pack or not. If consistent, the processing proceeds to step P4 in which is referred to the ink table, which is set in advance in accordance with the ink type in each ink pack, and then, in step P5, the amount of ink in the ink pool 15 is detected. If it is judged in step P3 that the instructed printing method is inconsistent with the ink type, the processing proceeds to step P6 in which a warning indicating the wrong ink is displayed. This display of warning can be performed, for example, using the operation panel 54. After the warning is displayed, the processing proceeds to step P7 in which is judged whether the ink is replaced or not. If the ink is replaced, the processing proceeds to step P2, and if not, the processing returns to step P6.

Master Detection Means

Here is described master detection means for discriminating whether the master installed in the printing device is the master for UV ink or the master for non-UV ink.

In the present embodiment, the master type is identified by discriminating the difference in inner diameters of master paper cores configuring the core portion of the master roll 2.

Figure 8:
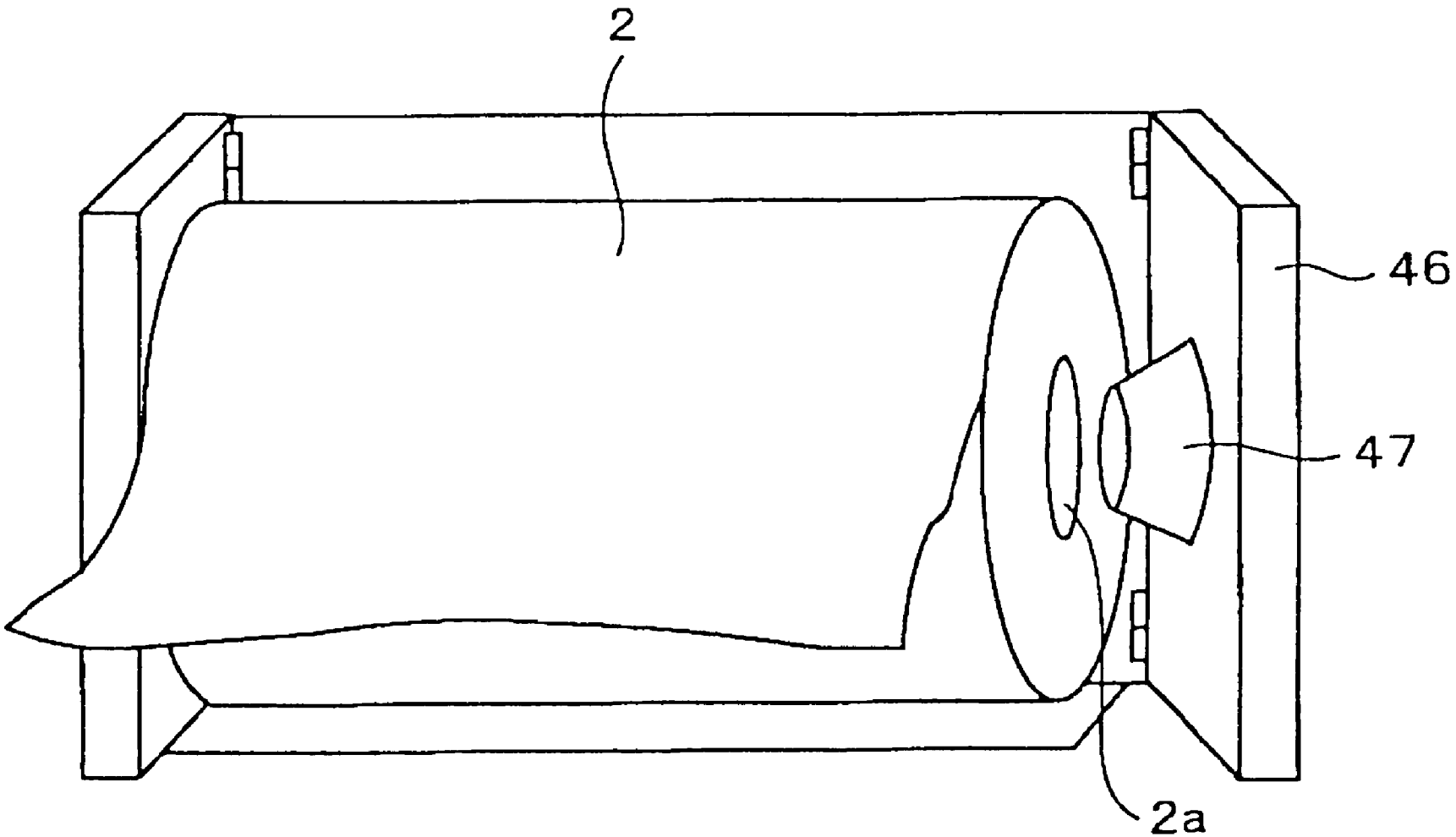
FIG. 8 is a perspective view showing a master roll and a holder.

As shown in FIG. 8, the master roll 2 is set in the stencil printer, with the support of a holder 46 at both sides in the width direction of the master roll. The size of a flange 47 in the form of a tapered axis, which is provided in the holder 46, is made variable in accordance with the inner diameter of a master paper core 2*a*, and the presence of variation is detected, whereby the master types are discriminated.

Figure 9:
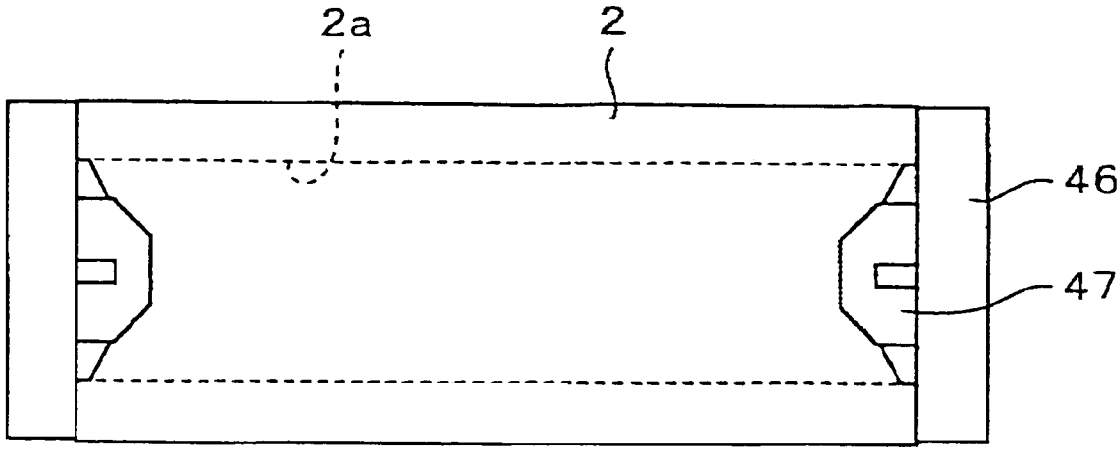
FIG. 9 is a front view showing a master roll having a master paper core with a small diameter.
Figure 10:
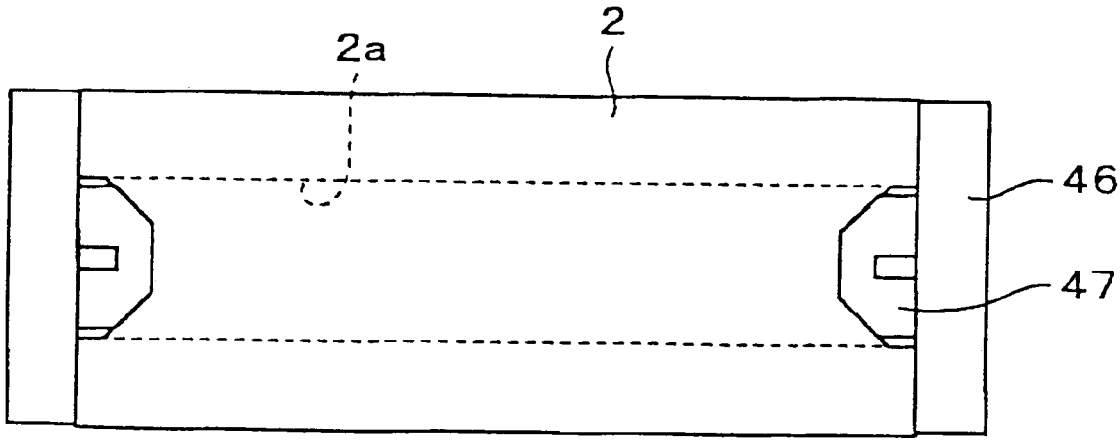
FIG. 10 is a front view showing the master roll having the master paper core with a small diameter.

FIG. 9 shows a state in which the size of the flange 47 is changed and inserted into the inner diameter of the paper core when the diameter of the paper core 2*a* is large, and FIG. 10 shows a state in which the size of the flange 47 is changed and inserted into the inner diameter of the paper core 2*a* when the diameter of the paper core 2*a* is small. An example of the configuration of such variable flange 47 is described.

Figure 11:
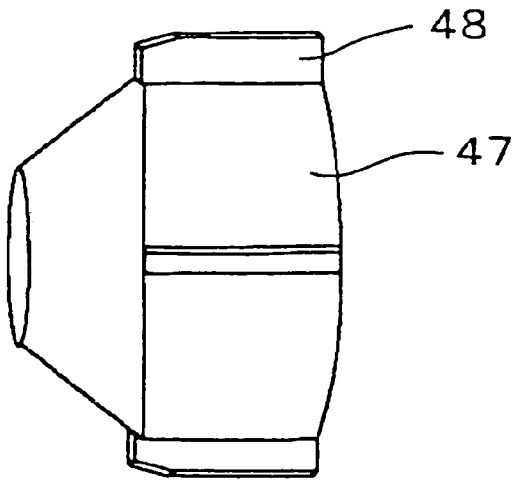
FIG. 11 is a perspective view showing a flange which fits with the master paper core.
Figure 12:
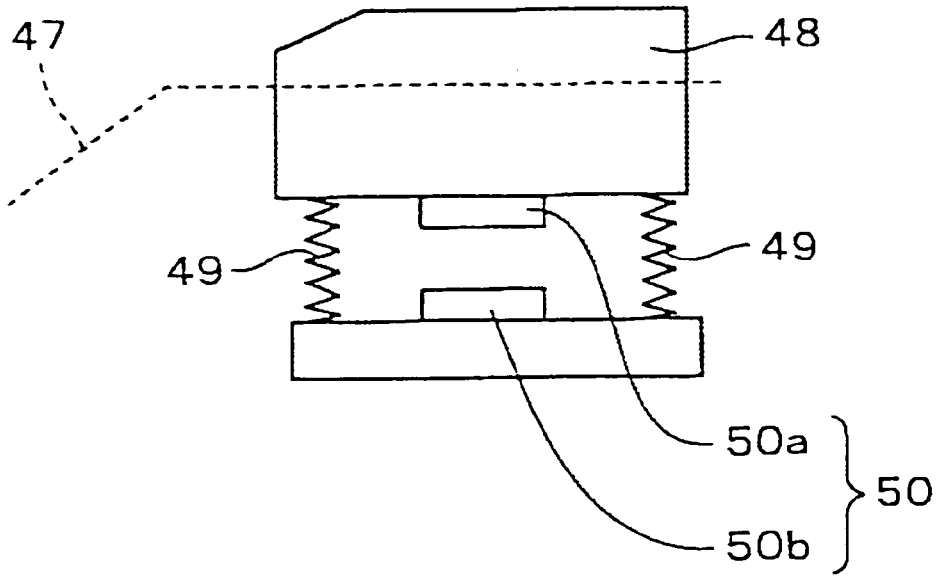
FIG. 12 is a figure showing an internal structure of the flange.

FIG. 11 shows the entire flange 47, and FIG. 12 shows an enlarged flange diameter adjusting movable member 48, which is a substantial component of the flange 47, and enlarged movable means of the movable member 48. The flange diameter adjusting movable members 48 are installed inside a slit on a circumferential surface portion of the flange 47, so as to be able to protrude radially with respect to a position which divides the circumference.

Further, as shown in FIG. 12, each of the plurality of flange diameter adjusting movable members 48 has force in order to protrude radially by being pressed outward by a stretchable spring 49, and such protrusion is locked by a stopper which is not shown. In this manner, each of the flange diameter adjusting movable members 48 is swingably supported, and part of the flange diameter adjusting movable member 48 protrudes from the inside of the flange 47.

As shown in FIG. 9, when the diameter of the master paper core 2*a* is large, the flange diameter adjusting movable member 48 protrudes until it abuts on the inner diameter portion of this large master paper core 2*a*. Also in the case of the master paper core 2*a* with the small diameter as shown in FIG. 10, the flange diameter adjusting movable member 48 protrudes until it abuts on the inner diameter portion of this small master paper core 2*a*. Therefore, both cases are suitable for the inner diameter portion of the master paper core 2*a*.

Here, as shown in FIG. 12, a pair of electrical contacts 50*a*, 50*b* are provided between a bottom portion of the flange diameter adjusting movable member 48, which swings with expansion and contraction of the spring 49, and a portion facing the bottom portion. In the case of the paper core 2*a* with a large inner diameter as shown in FIG. 9, the amount by which the flange diameter adjusting movable member 48 is pressed down toward the inside of the flange 47 is small, thus the pair of electrical contacts 50*a*, 50*b* are brought to a non-contact state. In the case of the paper core 2*a* with a small inner diameter as shown in FIG. 10, on the other hand, the flange diameter adjusting movable member 48 is pressed down toward the inside of the flange 47, thus the pair of electrical contacts 50*a*, 50*b* are brought to a state of contact.

In this manner, the electrical contacts 50*a*, 50*b* can be brought to a non-contact state when the inner diameter of the paper core 2*a* is large, and the electrical contacts 50*a*, 50*b* can be brought to a state of contact when the inner diameter of the paper core 2*a* is small. Therefore, for example, the master for UV ink is wrapped around the master roll having the large paper core 2*a*, and the master for non-UV ink is wrapped around the master roll having the small paper core 2*a*, whereby ON/OFF of the electrical contacts 50*a*, 50*b* can be detected, and thus it is possible to discriminate whether the installed master roll is the master roll for UV ink or the master roll for non-UV ink.

The electrical contacts 50*a*, 50*b* configure a master type detection sensor 50, and a master type discrimination means 64 can identify the type of master on the basis of either information obtained when ON of the electrical contacts is detected or information obtained when OFF of the electrical contacts is detected. It should be noted that, regarding the method of identifying the master type other than using the inner diameter of the paper core of the master roll, IC tags may be provided inside the master paper core or a black sticker may be applied either one of the master rolls to perform discrimination, as in the abovementioned method of discriminating the ink types by means of the ink detection means.

[2.2] Removed-Master Storage Device Detection Means

Figure 13:
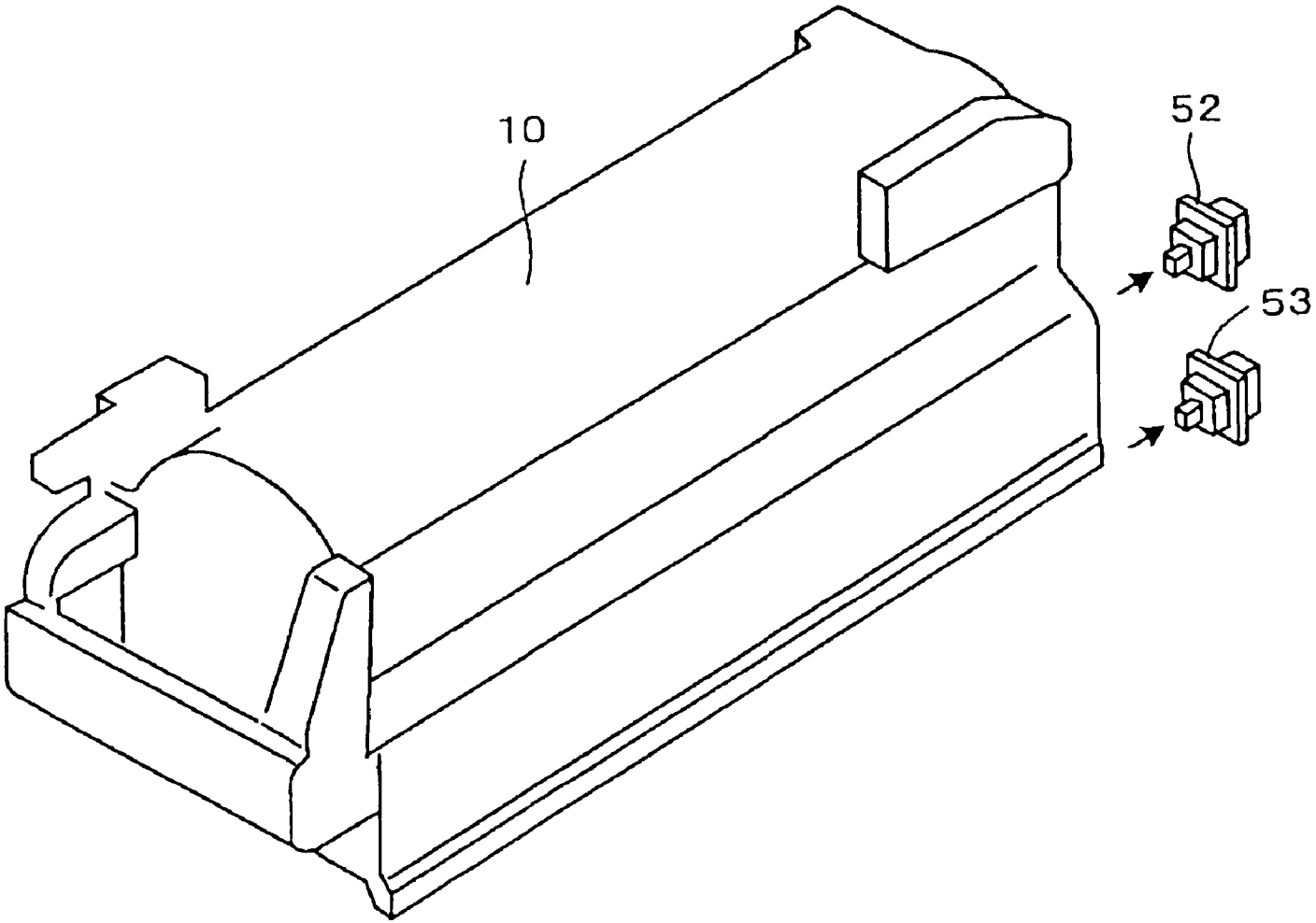
FIG. 13 is a perspective view showing an appearance of a removed-master storage device.

FIG. 13 is used to describe removed-master storage device detection means for detecting whether the removed-master storage device 10 installed in the printing device main body 72 is the removed-master storage device for UV ink or the removed-master storage device for non-UV ink.

In the present embodiment, discrimination of whether the removed-master storage device 10 installed in the printing device main body 72 is for UV ink or non-UV ink is performed by using removed-master storage devices 10 which have different shapes in accordance with the ink type and by discriminating changes in the shapes.

The shape of the removed-master storage device 10 is changed by detecting the presence of a notch. The removed-master storage device 10 is provided with a removed-master storage device presence sensor 52, which is a push switch, and a removed-master storage device type detection sensor 53, which is also a push switch. Regarding the removed-master storage device 10 which is detachable with respect to the printing device main body 72, the structure of the removed-master storage device 10 having the master for UV ink stored therein and the structure of the removed-master storage device 10 having the master for non-UV ink stored therein are the same, except for the presence of notches. Either one of the removed-master storage devices 10 is installed in the same printing device main body 72 in accordance with the type of ink used.

Therefore, either the removed-master storage device for storing the master for UV ink, or the removed-master storage device for storing the master for non-UV ink is provided with a notch so that the push switches are not pressed or "missed" in a state where the removed-master storage device is installed. For example, ink type discrimination means 63 is caused beforehand to store information indicating that the removed-master storage device with the notch is the removed-master storage device for storing a removed master (used master) for UV ink and information indicating that the removed-master storage device without the notch is the removed-master storage device for storing a removed master (used master) for non-UV ink.

Consequently, it is possible to judge that the installed removed-master storage device 10 is the one for the non-UV ink master if the removed-master storage device presses the push switch of the removed-master storage device type detection sensor 53, or that the installed removed-master storage device 10 is the one for the UV ink master if the removed-master storage device 10 does not press the push switch of the removed-master storage device type detection sensor 53. In this manner, the ink type discrimination means 63 (FIG. 5) on the printing device main body 72 side identifies the ink type on the basis of the presence of contact of the removed-master storage device 10 with the removed-master storage device type detection sensor 53.

It should be noted in FIG. 13 that an arrow is used to indicate the direction in which the removed-master storage device 10 presses the removed-master storage device presence sensor 52 and removed-master storage device type detection sensor 53. The positions of the removed-master storage device presence sensor 52 and the removed-master storage device type detection sensor 53 with respect to the removed-master storage device 10 are shown slightly away from the original set positions, for the reason of illustration. Further, the removed-master storage device 10 shown in the figure is the one without the notch. It should be noted that, in the removed-master storage device 10 as well, IC tags or black sticker may be used to perform discrimination, as in the ink detection means of the master detection means.

[2.3] Pressing Means

Figure 14:
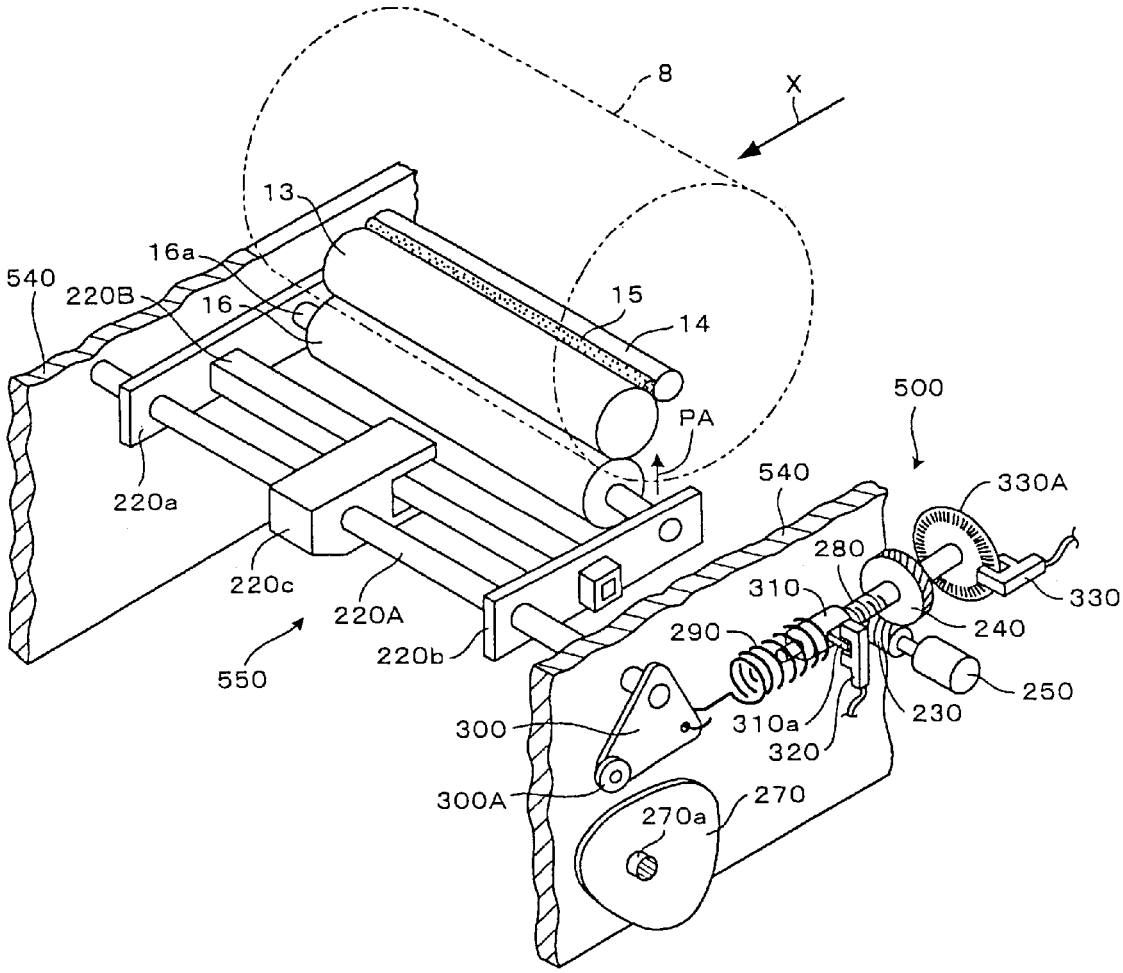
FIG. 14 is a perspective view showing pressing means of a print drum.

FIG. 14 is used to describe pressing means for performing printing by pressing the printing paper 17 which is the print medium and the print drum 1, the pressing means being disposed in opposition to the print drum 1.

The press roller 16 is disposed in the vicinity in the lower part of the outer circumferential surface of the print drum 8 which faces the ink roller 13. The press roller 16 is displaceable in a vertical direction between the printing press position for pressing against the outer circumferential surface of the print drum 8 by means of press roller displacement means 550 described hereinafter, and a non-printing press position which is apart from the printing press position. In other words, the press roller 16 can be freely released with respect to the outer circumferential surface of the print drum 8, and pressing force PA (sometimes referred to as "printing pressure PA" hereinafter) for the press roller 16 with respect to the print drum 8 is made variable by after-mentioned pressing force adjustment means 500 for changing the pressing force PA.

The press roller 16 has the well-known structure in which the inner circumferential portion thereof is formed of a cored bar and the outer circumferential portion of same is formed of an elastic body such as rubber, the press roller 16 is provided in an extended fashion along the direction of an axis line of the print drum 8, and roller axes 16*a* are integrally formed on both ends of the cored bar respectively.

The pressing force adjustment means 500 and the press roller displacement means 550 have the same configuration and structure as those shown in, for example, FIG. 1 and the like of Japanese Patent Application Laid-Open No. H10-315599 which is proposed by the applicant of the present application, thus hereinafter these configurations and functions are explained simply and clearly. The press roller displacement means 550 has the well-known configuration/function of selectively displacing the press roller 16 between the printing press position for pressing against the outer circumferential surface of the print drum 8 and the non-printing press position which is apart from this printing press position.

The press roller displacement means 550 is mainly configured with a horizontal axis 220A, a pair of right and left arms 220*a*, 220*b*, an intermediate stay 220B, vertically moving arm 220C, spring-fixing arm 300, print press spring 290 (tension coil spring) and a cam 270.

The horizontal axis 220A is provided in an extended fashion so as to be substantially parallel with the right and left roller axis 16*a*, and the both end portions of the horizontal axis 220A are supported by a pair of right and left main body plates 540 so as to be rotatable by a predetermined angle. Free ends of the pair of right and left arms 220*a*, 220*b* are swingable around the horizontal axis 220A, and the arms 220*a*, 220*b* rotatably support both ends of the roller axes 16*a* of the press roller 16. Furthermore, the rear ends of the arms 220*a*, 220*b* supported in the vicinity of the both end portions of the horizontal axis 220A so as to be rotatable by the predetermined angle.

The intermediate stay 220B is supported by the pair of arms 220*a*, 220*b* in substantially the central portion of the press roller 16 and of the horizontal axis 220A, and connects the pair of arms 220*a*, 220*b* with each other. A rear end of the vertically moving arm 220C is fixed to the central portion of the horizontal axis 220A. A small space between tree ends of the arm 220C hold and support the central portion of the intermediate stay 220B. The arm 220C also transmits rotation of the horizontal axis 220A by the predetermined angle to the intermediate stay 220B.

A rear end portion of the spring-fixing arm 300 is attached integrally to an end of the horizontal axis 220A at the right main body plate 540, and a free end portion of same has a swingable cam follower 300A around the horizontal axis 220A. An end of the print press spring 290 (tension coil spring) is locked with the abovementioned free end portion of the spring-fixing arm 300. The print press spring 290 swings and biases the spring-fixing arm 300 toward the direction in which the press roller 16 is pressed against the outer circumferential surface of the print drum 8. The cam 270 is rotatably supported by a cam shaft 270*a* on the right main body plate 540, and is selectively engaged with the cam follower 300A of the spring-fixing arm 300.

As described above, by providing a small space between the intermediate stay 220B and the vertically moving arm 220C, the balance on the right and left sides of the press roller 16 can be adjusted when printing pressure is applied. The intermediate stay 220B is made from metal, and the cross sectional shape thereof is a square.

After the intermediate stay 220B is inserted into the pair of arms 220*a*, 220*b*, retaining pins, which are not shown, are driven into a section adjacent to the external wall surfaces of the pair of arms 220*a*, 220*b*, thereby retaining the intermediate stay 290 in the paper width direction. The cam 270 is rotatably supported by the cam shaft 270*a* on the right main body plate 540. The spring-fixing arm 300 is in the form of a triangle plate, and is selectively engaged with a circumferential surface of the contour of the cam 270 via the cam follower 300A. The vertically moving arm 220C and the horizontal axis 220A are integrally fixed by press-fitting installation of fixing pins, which are not shown.

The same press roller drive means (not shown) as the one shown in, for example, FIG. 1 and the like of Japanese Patent Application Laid-Open No. H10-315599, which is proposed by the applicant of the present application, is disposed around the press roller 16. The press roller drive means comprises a main motor for driving the print drum 8, and has a known structure in which the press roller 16 is swung/displaced between the printing press position and non-printing press position in synchronization with the rotation of the print drum 8. Furthermore, those times other than when passing the papers, the press roller 16 held by unshown locking means at the non-printing press position which is part from the outer circumferential surface of the print drum 8.

The pressing force adjustment means 500 is mainly configured with a printing pressure control motor 250, movable axis 310, rotation axis 280, worm wheel 240, encoder 330A, pressing force detection sensor 330, blocking plate 310A, and photosensor 320.

The printing pressure control motor 250 is fixed to the right main body place 540 via an unshown member, is attached with a worm 230 at an output shaft thereof, and can be rotated normally or inversely. The movable axis 310 is locked with the other end of the print press spring 290, and is supported movably in only a back-and-forth direction of a printing paper conveyance direction X via a groove (not shown) formed in the left main body plate 540. The inner circumferential portion of the movable axis 310 is formed with female threads.

The rotation axis 280 is a rotatable axis, an outer circumferential portion of which is formed with male threads engaged with the female threads of the movable axis 310. The worm wheel 240 is fixed to the rotation axis 280, an is always engaged with the worm 230. The encoder 330A is fixed to an end of the rotation axis 280 and detects the number of rotations of the worm wheel 240. The pressing force detection sensor 330 is supported by an unshown member in a predetermined position of the right main body plate 540, and holds the encoder 330A at predetermined spacings.

The blocking plate 310A is formed in a protruding fashion from the outer circumferential portion of the movable axis 31. The photosensor 320 is supported by an unshown member on a predetermined position of the right main body plate 540, holds a blocking plate 310*a* at predetermined spacings, and detects a home position (position indicating a standard state of printing pressure) of the encoder 330A.

The encoder 330A is a well-known encoder comprising an unshown slit disk having numbers of slits. By detecting the number of rotations of the worm wheel 240, i.e. the amount of movement of the movable axis 310 in the back-and-forth direction of the printing paper conveyance direction X, in other words, the amount of displacement in the tension length of the press pressure spring 290, by the encoder 330A and the pressing force detection sensor 330 cooperating with each other, the pressing force PA can be detected indirectly.

Since the press roller displacement means 550 and the pressing force adjustment means 500 are configured as above, the both ends of the print press spring 290 are locked with the free end portion of the spring-fixing arm 300 and the movable axis 310 in a displaceable fashion.

Accordingly, the rotational amount of the printing pressure control motor 250 is transmitted from the worm 230 to the worm wheel 240 through the rotary drive in normal rotation or inverse rotation of the printing pressure control motor 250, and conversion is made into linear movement of the movable axis 310 in the back-and-forth direction of the printing paper conveyance direction X, whereby the movable axis 310 is moved forward or backward in the printing paper conveyance direction X. Consequently, the tension length of the print press spring 290 changes, and the tension of the print press spring 290 changed, thus the pressing pressure (printing pressure) PA of the press roller 16 with respect to the print drum 8 is changed.

[3] Appropriateness Assessment Control of Printing Method

The stencil printing device of the present embodiment can perform printing by selecting the printing methods of printing using UV ink and non-UV ink in a single printing device. In such a printing device, a special ink and master as supplies are required in each printing method. Unlike the non-UV ink, the UV ink contains UV curable resin, initiating reagent, and various solvents for solving these substances, and when the master for non-UV ink is used when using the master for UV ink, corrosion occurs due to the effects of the substances contained in the UV ink, reducing printability and accuracy of a printed image.

The substances contained in the UV ink cause corrosion in the master or resin such as certain type of plastic, and also cause skin irritation, thus the removed-master after printing needs to be handled carefully. The removed-master storage devices for UV ink and non-UV ink need to be used separately in accordance with the printing methods, since the removed-master discarding method used when corrosion occurs in the plastic of the removed-master storage device or when discarding removed masters is different between the removed-master storage devices for UV ink and non-UV ink.

The master for UV ink comprises a material which is unaffected by or susceptible to the solvent substances, thus solvent resistance and heat resistance are improved. For this reason, difference is generated in perforated diameters between the master for UV ink and the master for non-UV ink even when applying the same supply energy. Therefore, the thermal head supply energy at the time of master-making perforation needs to be larger in the case of the master for UV ink than in the case of the master for non-UV ink, and is preferably changed in such manner in accordance with the printing methods. In the case of printing using the UV ink, printing is mostly performed using a paper such as a coated paper on which feathering or spread of ink hardly occurs, thus it is preferred that the thermal head supply energy be changed when performing master-making perforation in order to spread the ink. Further, only adjusting the thermal head supply energy is not enough to adjust the range of feathering or spread of the ink, thus the adjustable range is expanded by changing the pressing force against the print drum or printing paper by means of the press roller 16, in accordance with the printing methods.

Therefore, appropriateness or inappropriateness of a combination can be found whether (a) print drum, (b) ink type, (c) master type, and (d) removed-master type (type of the removed-master storage device) are for UV ink or for non-UV ink. Further, the printing conditions requires (e) control of the thermal head supply energy at the time of master-making perforation, and (f) control of printing pressure.

In the present embodiment, the state of a member which is set as-is and a supply state are recognized by the control means as follows.

(a) For the type of the print drum, the printing device control means 56 is caused to recognize whether the print drum installed in the stencil printing device is for UV ink or for non-UV ink, in accordance with the information from the print drum control means 80.

(b) For the ink type, the printing device control means 56 is caused to recognize whether the ink pack is for storing the UV ink or for storing non-UV ink, by detecting the ink type using the ink type detection sensor 44, which is described as the ink detection means, and by means of the ink type discrimination means 63.

(c) For the master type, the printing device control means 56 is caused to recognize the master type by detecting the master type using the master type detection sensor 50, which is described as the master detection means, and by means of the master type recognition means 64.

(d) For the removed-master type (type of the removed-master storage device, the printing device control means 56 is caused to recognize the removed-master storage device by detecting the removed-master storage device type using the remove-master storage device type detection sensor 53, which is described as the removed-master storage device detection means, and by means of the removed-master storage device type discrimination means 65.

A combination table showing combinations of the print drums, inks, masters, and removed-master devices as shown in FIG. 17 is stored in the printing device control means 56 in advance. It should be noted in FIG. 17 that the drum type indicates whether the drum type is for UV ink or for non-UV ink, and the drum type for UV curable ink is indicated as UV, and the print drum for non-UV curable ink is indicated as non-UV.

Figure 16:
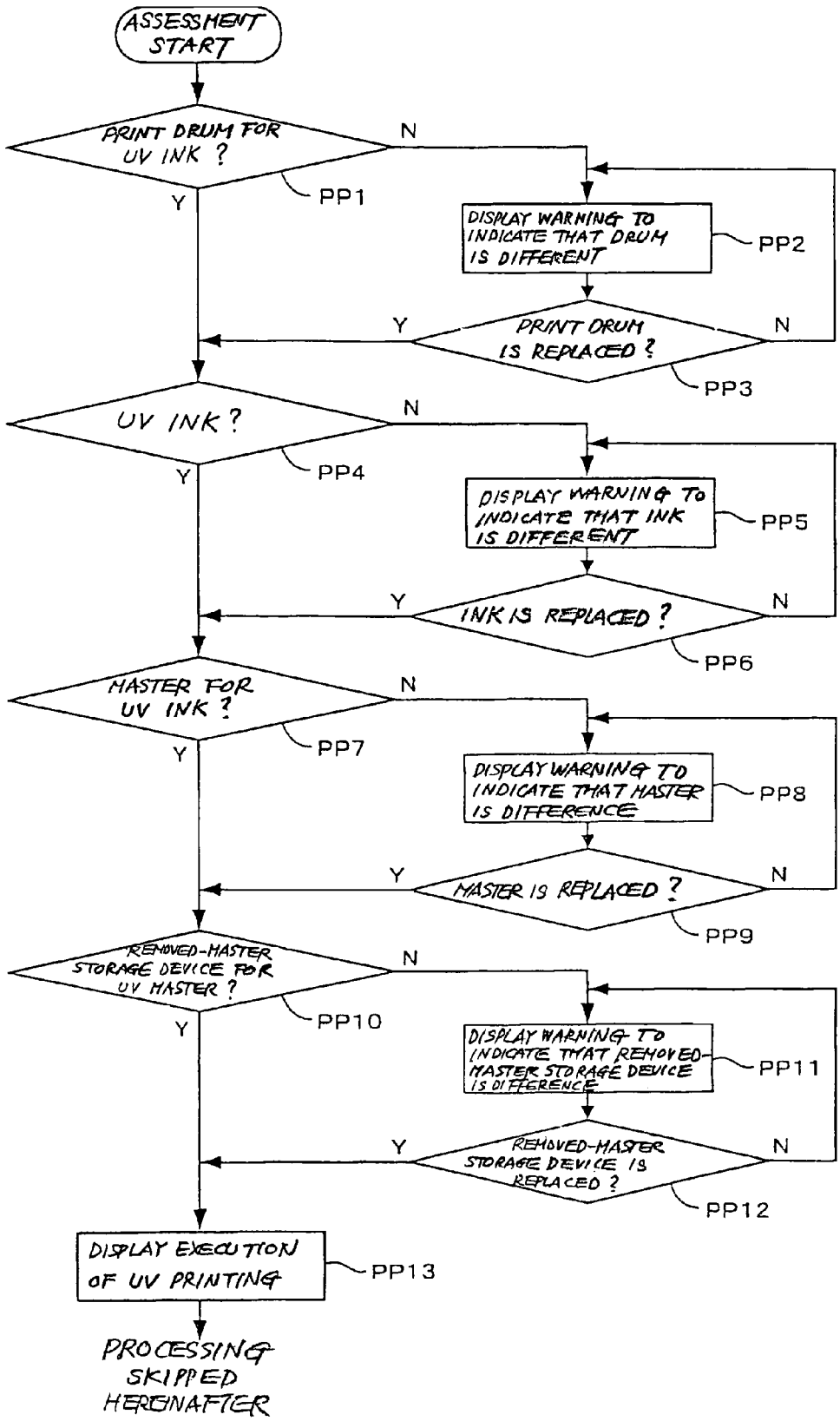
FIG. 16 is a flowchart of appropriateness assessment processing for an applied member when performing UV printing.

The printing device control means 56 collates recognition results of (a) through (d) with each column of drum type, ink type, master type, and removed-master type in FIG. 16, performs assessment on appropriateness in accordance with the contents of a printing method instruction (whether printing using UV ink or printing using non-UV ink) which is issued by a user operating the operation panel 54, and displays a result of assessment on the operation panel 54 in accordance with the assessment results shown in the assessment list of Table 1.

Figure 15:
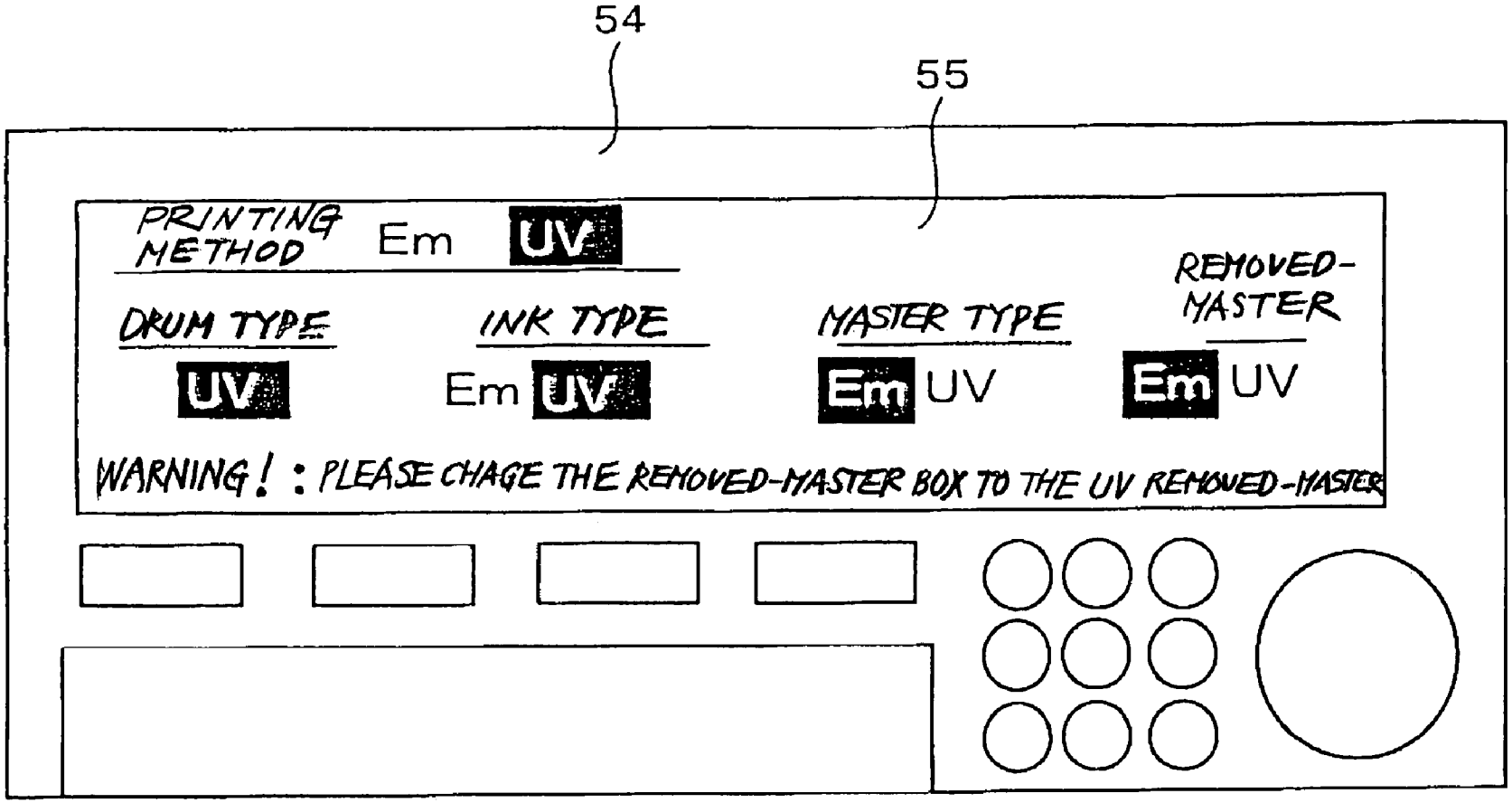
FIG. 15 is a front view showing an operation panel

An example of display on the operation panel 54 is shown in FIG. 15. In a liquid crystal display portion 55 of FIG. 15, "printing method" is an item instructed by the user. In the case of printing using the non-UV ink, a character portion of "Em" is highlighted, and, in the case of printing using the UV ink a character portion of "UV" is highlighted. In the example shown in the figure, the character portion of "UV" is highlighted.

In "drum type," the type of print drum is highlighted. In "ink type," "Em" is highlighted in the case of non-UV ink, and "UV" is highlighted in the case of UV ink. In the example shown in the figure, the character portion of "UV" is highlighted.

In "master type," "Em" is highlighted in the case of the master for non-UV ink, and "UV" is highlighted in the case of the master for UV ink. In the example shown in the figure, the character portion of "Em" is highlighted.

In "removed-master," "Em" is highlighted in the case of the removed-master storage device for non-UV ink, and "UV" is highlighted in the case of the removed-master storage device for UV ink. In the example shown in the figure, the character portion of "Em" is highlighted.

For the print drum type, various solvents are used in the UV ink, thus solvents having high solvent resistance need to be used in the ink pump or hose configuring the print drum 8. Therefore, although printing using the UV ink cannot be performed in the drum for non-UV ink, printing using the non-UV ink can be performed in the drum for UV ink. Printing cannot be performed if the combined ink and master are not appropriate for each other. If the UV ink is used in the master for non-UV ink, the master for non-UV ink is corroded by the UV ink, thus this combination is not applicable. On the other hand, if the non-UV ink is used in the master for UV ink, large amount of ink is discharged from the UV master which is perforated for the use of the UV ink, whereby the accuracy of an image is reduced, thus this combination is not applicable. In the case of the removed-master storage device 10, as in the case of the print drum 8, the removed-master storage device for UV ink can store a removed-master in which the non-UV ink is used.

If the ink type and the master type do not match, a warning such as "please change the master" is displayed on the main body operation panel 54 shown in FIG. 15, or printing is disabled, even when other conditions match. Further, if a combination after addition of the removed-master type (removed-master storage device) is not appropriated, a warning such as "please change the master" is displayed on the main body operation panel 54 shown in FIG. 15, or printing is disabled, even if other conditions match.

The user who changes the printing method frequently needs to check the supplies each time, and such work is troublesome. However, as described in the present embodiment, in the method of recognition by means of the control means, operation is simple, and printing can be performed under the printing conditions of the printing device in accordance with a selected ink to be used. furthermore, inappropriate usage of different types of removed-master storage devices can be prevented beforehand, thus the removed-storage devices is prevented from being damaged by being used inappropriately or by dirt on fingers of the user.

For example, FIG. 16 shows a flow of assessment processing when the user instructs UV printing in which the UV ink is used. If it is judged in step PP1 that the print drum for UV ink is not installed, processing proceeds to step PP2, in which a warning is displayed on the operation panel 54 to indicated that the drum is different. If it is judged in step PP3 that the print drum is replaced, the processing proceeds to step PP4.

If it is judged in step PP3 that the print drum is replaced, the processing proceeds to step PP4, in which it is judged whether the ink pack for UV ink is filled or not. If the UV ink is not used, the processing proceeds to step PP5, in which a warning is displayed on the operation panel 54 to indicated that the ink is different. If it is judged in step PP6 that the ink is replaced, the processing proceeds to step PP7.

In step PP7 it is judged whether the master is the one for UV ink. If the master is not for UV ink, the processing proceeds to step PP8, in which a warning is displayed on the operation panel 54 to indicated that the master is different. If it is judged in step PP9 that the master is replaced, the processing proceeds to step PP10.

In step PP10 it is judged whether the removed-master storage device is the one for UV ink. If the removed-master storage device is not for UV ink, the processing proceeds to step PP11, in which a warning is displayed on the operation panel 54 to indicated that the removed-master storage device is different. If it is judged in step PP12 that the removed-master storage device is replaced, the processing proceeds to step PP13, in which execution of UV printing is displayed on the operation panel and the like.

Next, (e) control of the thermal head supply energy at the time of master-making perforation, and (f) control of printing pressure are described.

After determining to use either the printing method of UV printing or the printing method of non-UV printing, the printing device control means 56 instructs, in accordance with the printing method, a stencil master-making portion control circuit 57 and a printing pressure portion drive control circuit 58 to execute the control method based on the printing method. As an example of such instruction, comparison of the supply energy to the perforation means (thermal head 5) between UV printing and non-UV printing is shown in FIG. 18. Since the supply energy value has the characteristics that an optimal set value is changed according to the ink type, thus the numeric values shown in FIG. 18 are not are not necessarily applied as the supply energy value.

In control of the supply energy, the printing method is detected, and also an outside air temperature is detected by an unshown thermister which is set in the printing device main body, and control corresponding to the temperature is performed. Perforation using the thermal head or laser can be considered in perforation on the master. However, in the present embodiment, the thermal head is used as the perforation means, and the supply energy is controlled by heat energy by changing the time (pulse width) for energizing the supply energy to the thermal head.

Control of the perforation diameter by controlling the pulse width of the thermal head means control of energization time for the thermal head 5. The thermal head 5 itself is the electrical resistance, thus an element in the thermal head is heated by energizing the thermal head 5. When designing the thermal head, voltage applied to the thermal head is set in consideration of the life or efficiency of the thermal head.

When controlling the thermal had by constantly applying voltage thereto, the perforation diameter tends to increase as the outside air temperature rises. Therefore, pulse down control of reducing the energization time as the outside air temperature rises is performed. The energization time is reduced as the rate of reduced pulse increases, thus the perforation diameter is reduced. Non-UV printing is started when the outside air temperature is 10° C. and the reduced pulse rate is 10%, and control is performed such that the pulse is reduced by 1% every time the temperature increases by 1 C °. In the present embodiment, the reason that non-UV printing is not started when the reduced-pulse rate is 0% is that, if the maximum power for control is set to 0%, the life of the thermal head is reduced and guarantee against the long-term use of the thermal head cannot be provided, thus certain allowance for protecting the thermal is secured.

In the present embodiment described here, control is performed to start UV printing when the reduced-pulse rate is 5% in order to respond to the UV master on which perforation is difficult to be performed, and to the paper such as coated paper which is frequently used in UV printing and has poor ink diffusivity. Since the supply energy required for perforation of the master used in UV printing becomes larger, compared to the case of non-UV printing, thus the perforation diameter increased and the amount of ink spreading on the paper also increases.

When the UV ink is detected by the ink detection means, the printing device control means 56 adjusts, by means of the stencil master-making portion control circuit 57, the supply energy for the master perforation means (thermal head 5) to the supply energy suitable for UV ink which is different from the one used when performing master-making using non-UV ink. In the present embodiment, the supply energy is adjusted so that the supply energy at the time of master-making using the UV ink becomes larger than the supply energy for master-making using non-UV ink.

Accordingly, when performing UV printing, optimal thermal head energy for the master for UV ink is added, whereby fading of an image and degradation of the build up of the image due to poor perforation can be avoided, the ink can be spread well when using papers having poor ink diffusivity, and the quality of an image can be improved.

It should be noted that in some UV inks have lower viscosity than non-UV ink and may be discharged from the perforation portion. In this case the supply energy is controlled so that the perforation diameter is smaller than that when using non-UV ink.

In accordance with the printing method, the printing device control means 56 instructs the stencil master-making portion control circuit 57 and the printing pressure portion drive control circuit 58 to execute the control method based on the printing method. As an example of such instruction, comparison of printing pressure is shown in FIG. 19.

The first speed, third speed, and fifth speed in FIG. 19 indicate values related to the rotational amount of the printing pressure control motor 250, and the pressing force PA increases as the speed increases such as first speed<third speed<fifth speed.

As in the case of controlling the thermal head, control of the printing pressure is performed by detecting outside air pressure by means of the unshown thermister set in the printing device main body 72, and using the detected temperature. Generally, the ink viscosity tends to increase and the amount of discharged ink is reduced under the environment of lower temperature, thus, for example, the printing pressure (pressing force PA shown in FIG. 14) is set high to increase the discharged amount.

Under the environment of higher temperature, on the other hand, the printing pressure is set low in order to limit discharge of the ink. Furthermore, the higher the printing speed, the lower the discharged amount, and the lower the printing speed, the higher the discharged amount. Therefore, as in the case of master perforation in which the printing pressure is controlled so that fixed amount of ink is discharged without any influence of the environment or the speed which tends to increase, the printing pressure is not necessarily higher when using the UV ink than when using the non-UV ink, in accordance with the ink type.

When the UV ink is detected by the ink detection means, the printing device control means 56 adjusts the printing pressure (pressing force) of the press roller 16 to the pressing force which is suitable for non-UV curable ink different from the above mentioned non-UV curable ink. In the present embodiment in particular, the pressing force is adjusted so that the printing pressure in the non-UV ink is higher than the printing pressure in the UV ink. In this manner, when performing UV printing, optimal printing pressure corresponding to the UV supplies is added, whereby optimal amount of discharged ink corresponding to the ink, master, and printing paper can be obtained, and the quality of an image can be improved.

According to the present invention, printing is possible with either the UV ink or non-UV ink, and also printing under the printing conditions of the printing device in accordance with the selected ink to be used can be performed with simple operation.

Various modifications will become possible for those skilled in the art after receiving the teachings of the present disclosure without departing from the scope thereof.

What is claimed is:

1. A printing device capable of printing with either UV curable ink or non-UV curable ink, the printing device comprising:

ink detection means for detecting prior to printing with ink, whether the ink installed in a print drum is the UV curable ink or the non-UV curable ink;

master detection means for detecting whether a master installed in the printing device is a master for UV curable ink or a master for non-UV curable ink;

a removed-master storage device detection means for detecting whether a removed-master storage device installed in the printing device is a removed-master storage device for UV-curable ink or a removed-master storage device for non-UV curable ink; and control means for performing control prior to printing of executing at least one of a warning report and disabling a printing operation, when the type of the ink identified by the ink detection means is not consistent with at least one of the type of the master identified by the master detection means and the type of removed-master storage device identified by the removed-master storage device detection means.

2. The printing device according to claim 1, wherein the control means performs control of executing warning report and/or disabling printing operation, when the ink type and the master type detected respectively by the ink detection means and the master detection means are not consistent with the type of the removed-master storage device detected by the removed-master storage device detection means.

3. The printing device according to claim 1, further comprising:

display means for displaying whether the ink, the master, and the removed-master storage device are appropriate for the printing operation.

4. A printing device capable of printing with either UV curable ink or non-UV curable ink, the printing device comprising:

an ink detection device configured to detect prior to printing with ink, whether the ink installed in a print drum is the UV curable ink or the non-UV curable ink;

a master detection device configured to detect whether a master installed in the printing device is a master for UV curable ink or a master for non-UV curable ink;

a removed-master storage device detection device configured to detect whether a removed-master storage device installed in the printing device is a removed-master storage device for UV-curable ink or a removed-master storage device for non-UV curable ink; and a control device configured to perform control prior to printing of executing at least one of a warning report and disabling a printing operation, when the type of the ink identified by the ink detection device is not consistent with at least one of the type of the master identified by the master detection device and the type of removed-master storage device identified by the removed-master storage device detection device.

5. The printing device according to claim 4, wherein the control device performs control of executing warning report and/or disabling printing operation, when the ink type and the master type detected respectively by the ink detection device and the master detection device are not consistent with the type of the removed-master storage device detected by the removed-master storage device detection device.

6. The printing device according to claim 4, wherein a container for the UV curable ink has a first shape and a container for the non-UV curable ink has a second shape different from the first shape, and wherein the ink detection device detects the first or second shape to determine the type of ink within the container.

* * * * *